US010183408B2

(12) United States Patent
Furuta

(10) Patent No.: US 10,183,408 B2
(45) Date of Patent: Jan. 22, 2019

(54) RAZOR

(71) Applicant: KAI R&D CENTER CO., LTD., Seki-shi, Gifu-ken (JP)

(72) Inventor: Tatsuya Furuta, Seki (JP)

(73) Assignee: KAI R&D CENTER CO., LTD. (JP)

( * ) Notice: Subject to any disclaimer, the term of this patent is extended or adjusted under 35 U.S.C. 154(b) by 132 days.

(21) Appl. No.: 15/038,928

(22) PCT Filed: Nov. 26, 2014

(86) PCT No.: PCT/JP2014/081149
§ 371 (c)(1),
(2) Date: May 24, 2016

(87) PCT Pub. No.: WO2015/080113
PCT Pub. Date: Jun. 4, 2015

(65) Prior Publication Data

US 2017/0001323 A1 Jan. 5, 2017

(30) Foreign Application Priority Data

Nov. 27, 2013 (JP) ..... 2013-245130

(51) Int. Cl.
*B26B 21/52* (2006.01)
*B26B 21/40* (2006.01)
*B26B 21/22* (2006.01)

(52) U.S. Cl.
CPC ..... *B26B 21/521* (2013.01); *B26B 21/225* (2013.01); *B26B 21/227* (2013.01); *B26B 21/4012* (2013.01)

(58) Field of Classification Search
CPC ... B26B 21/521; B26B 21/225; B26B 21/227; B26B 21/4012
See application file for complete search history.

(56) References Cited

U.S. PATENT DOCUMENTS 4,200,976 A 5/1980 Gooding
5,253,420 A 10/1993 Althaus et al.
(Continued)

FOREIGN PATENT DOCUMENTS

EP 0 045 879 * 2/1982
EP 1990143 11/2008
(Continued)

OTHER PUBLICATIONS

International Search Report for Application No. PCT/JP2014/081149 dated Feb. 17, 2015.
(Continued)

*Primary Examiner* — Hwei C Payer
(74) *Attorney, Agent, or Firm* — Tarolli, Sundheim, Covell & Tummino LLP

(57) ABSTRACT

A blade cartridge includes a blade member provided with blades, a blade base member located on the back side of the blade cartridge, and a top member located on the front side of the blade cartridge. The blade member is arranged between the blade base member and the top member. The cutting edge of each blade is exposed through the top member. A blade supporting portion provided in the blade member has a plurality of step plates arranged in a blade arrangement direction, which is orthogonal to the direction in which the cutting edge extends. A reinforcement plate portion, which increases the rigidity of the step plate, is provided while being bent from the step plate. The blade supporting portion is also provided with a bridge portion for mutual coupling.

7 Claims, 14 Drawing Sheets

(56) References Cited

U.S. PATENT DOCUMENTS

| | | | | |
|---|---|---|---|---|
| 7,621,203 | B2 * | 11/2009 | Aviza | B26B 21/227 30/50 |
| 7,992,304 | B2 * | 8/2011 | Nakasuka | B26B 21/227 30/50 |
| 8,046,920 | B2 * | 11/2011 | Nakasuka | B26B 21/227 30/50 |
| 8,104,179 | B2 * | 1/2012 | Nakasuka | B26B 21/227 30/50 |
| 8,381,406 | B2 * | 2/2013 | Miyazaki | B26B 21/225 30/51 |
| 2004/0216310 | A1 | 11/2004 | Santhagens Van Eibergen et al. | |
| 2005/0172489 | A1 | 8/2005 | Aviza | |
| 2005/0172494 | A1 | 8/2005 | Aviza et al. | |
| 2009/0288304 | A1 | 11/2009 | Denkert et al. | |
| 2010/0154220 | A1 | 6/2010 | Nakasuka | |
| 2010/0154222 | A1 | 6/2010 | Nakasuka | |
| 2010/0175265 | A1 | 7/2010 | Bozikis et al. | |
| 2010/0229397 | A1 | 9/2010 | Nakasuka | |
| 2016/0250764 | A1 | 9/2016 | Hashimoto | |
| 2017/0001323 | A1 * | 1/2017 | Furuta | B26B 21/225 |

FOREIGN PATENT DOCUMENTS

| | | | |
|---|---|---|---|
| EP | 3042741 | | 7/2016 |
| GB | 2531491 | * | 4/2016 |
| JP | 2007-215589 A | | 8/2007 |
| JP | 2007-215590 A | | 8/2007 |
| JP | 2007-215591 A | | 8/2007 |
| JP | 2009-540885 A | | 11/2009 |
| JP | 2012-024599 A | | 2/2012 |
| WO | 01/39937 | | 6/2001 |

OTHER PUBLICATIONS

European Search Report for corresponding European application No. 14865095.5 dated Sep. 11, 2017.

* cited by examiner 13
46
15
46

49
47
36e
(36)
47
49
36d
(36)
49
47
47
37
36b
(36)
49
34
36c
(36)

38c
38a
39
38d
35
34
16

13
46
15
46
35
34
16

17
52b
15
45
41

14b
35
17
51
52b
52b
52
45
38
41

12
16
15
17
45

12
17
15
16
48
48
14a
45
14b
48
48
14a

RAZOR

RELATED APPLICATIONS

The present invention is a U.S. National Stage under 35 USC 371 patent application, claiming priority to Ser. No. PCT/JP2014/081149, filed on 26 Nov. 2014; which claims priority from JP 2013-245130, filed 27 Nov. 2013, the entirety of both of which are incorporated herein by reference.

BACKGROUND OF THE INVENTION

The present invention relates to a razor supporting a blade in a razor head.

A razor head of a razor disclosed in Patent Document 1 includes a blade member to which blades are attached, a blade base member located on the back side of the razor head, and a top member located on the near side of the razor head. The blade member is clamped between the blade base member and the top member.

The blade member includes blades and a seat on which the blades are arranged. The seat includes a blade supporting portion that supports the blades and a plurality of elastic leg portions that supports the blade supporting portion. The elastic leg portions are arranged in the blade base member. A plurality of blade mounting portions, a plurality of bridge portions, and a plurality of shaving scum removal holes are formed in the blade supporting portion. The blade mounting portions each extend in the extending direction of the cutting edge of the corresponding blade and are arranged in the blade arrangement direction, which is perpendicular to the extending direction of the cutting edge. The bridge portions extend in the blade arrangement direction to couple the blade mounting portions together. The shaving scum removal holes are arranged one by one for each of the blade mounting portions and extend in the extending direction of the cutting edge of the corresponding blade in correspondence with the cutting edge. When the blades of the blade member press the skin surface, the elastic leg portions are elastically deformed in correspondence with the pressing force applied to the blades. This allows the seat, which supports the blades, to move between the blade base member and the top member.

PRIOR ART DOCUMENT

Patent Document

Patent Document 1: Japanese Laid-Open Patent Publication No. 2007-215590

SUMMARY OF THE INVENTION

If the rigidity of the blade supporting portion of the seat is excessively low, the pressing force applied to the blades tend to deform the blade supporting portion. This may cause movement of the blades on the blade mounting portions relative to one another and change the relative positions of the blades, thus adversely affecting shaving comfort of the razor. The blade supporting portion also tends to be deformed by the heat generated when the blades are attached to the blade mounting portions through spot welding or the like. This may change the relative positions of the blade mounting portions at the time of welding the blades and also change the relative positions of the blades, thus adversely affecting the shaving comfort of the razor. To solve this problem, the thickness of the blade supporting portion may be increased to improve the rigidity. This, however, would hamper bending of the blade supporting portion or welding of the blades to the blade mounting portions and is thus not preferable.

Accordingly, it is an objective of the present invention to provide a razor that maintains shaving comfort by improving the rigidity of a blade supporting portion and thus restraining deformation of the blade supporting portion.

To achieve the foregoing objective and in accordance with one aspect of the present invention, a razor is provided that includes a blade member including blades and a blade supporting portion, a blade base member arranged on a back side of the blade member, and a top member arranged on a near side of the blade member to hold the blade member between the top member and the blade base member with the blades of the blade member exposed to the exterior. The blade supporting portion includes a plurality of blade mounting portions arranged in a direction in which the blades are arranged, a reinforcement portion that improves rigidity of the blade mounting portions, and a coupling portion that couples the blade mounting portions together.

The reinforcement portion is arranged in the blade mounting portions. As a result, even if the thickness of the blade supporting portion is increased to such an extent that bending of the blade supporting portion or welding of the blades to the blade mounting portions is facilitated, the rigidity of the blade mounting portions can be set high. This restrains deformation of the blade supporting portion. The reinforcement portion is preferably formed by being bent from the blade mounting portions.

With this configuration, the reinforcement portion is bent from the blade mounting portions and thus formed easily.

The reinforcement portion is preferably arranged between the blade mounting portions and the blade base member by being bent from the blade mounting portions toward the blade base member.

With this configuration, the reinforcement portion is bent from the blade mounting portions and thus formed easily. Also, by arranging the reinforcement portion between the blade mounting portions and the blade base member, the reinforcement portion is arranged at such a position that the reinforcement portion does not interfere with the use of the razor.

The reinforcement portion is preferably arranged between the blade mounting portions and the blade base member.

With this configuration, by arranging the reinforcement portion between the blade mounting portions and the blade base member, the reinforcement portion is arranged at such a position that the reinforcement portion does not interfere with the use of the razor.

The blade mounting portions preferably extend in an extending direction of the blades.

With this configuration, the blades are mounted stably on the blade mounting portions.

The reinforcement portion is preferably one of a plurality of reinforcement portions that is arranged one by one for each of the blade mounting portions.

With this configuration, the reinforcement portions, which are arranged one by one for each of the blade mounting portions, improve the rigidity of the blade supporting portion, which has the multiple blades, as a whole.

The blade mounting portions and the reinforcement portion are preferably formed integrally with one another.

This configuration facilitates the forming of the blade mounting portions and the reinforcement portions. In this case, it is preferable to form the blade mounting portions and the reinforcement portions integrally preferably by pressing a plate.

It is preferable that the blade supporting portion be formed as an integral body.

This configuration facilitates the forming of the blade supporting portion.

The coupling portion preferably extends in an arrangement direction of the blades to couple the blade mounting portions together.

With this configuration, bridge portions improve the rigidity of the blade mounting portions.

The blade supporting portion preferably has shaving scum removal holes, which are located on both sides of the coupling portion and arranged in the extending direction of the blade supporting portion.

The removal holes preferably extend in an extending direction of cutting edges of the blades in correspondence with the cutting edges of the blades.

With this configuration, shaving scum is smoothly removed to the exterior through the shaving scum removal holes, which correspond to the blade mounting portions.

Each of the reinforcement portions is preferably bent toward the blade base member from one of two sides of the corresponding blade mounting portion in a blade arrangement direction, the one side being opposite from the cutting edge of the associated blade.

With this configuration, when the shaving scum removal holes are formed, the reinforcement portions are formed easily. In this case, it is preferable to arrange the reinforcement portions one by one in each of the blade mounting portions. This improves the rigidity of the blade supporting portion as a whole and facilitates removal of the shaving scum.

The reinforcement portions preferably extend in the extending direction of the cutting edge of each blade in correspondence with the shaving scum removal holes.

With this configuration, the reinforcement portions, which are arranged one by one for each of the shaving scum removal holes, improves the rigidity of the blade supporting portion as a whole regardless of formation of the shaving scum removal holes.

A seat arranged in the blade member preferably has a mounting base that is formed integrally with the seat and supported by the blade base member.

With this configuration, the mounting base allows stable arrangement of the seat of the blade member between the blade base member and the top member.

An elastic portion is preferably arranged between the mounting base of the seat and the blade base member to allow the blade member to move integrally in correspondence with pressing force applied to the blades of the blade member when the blades contact a skin surface.

The mounting base of the seat preferably has an elastic leg portion that is supported by the blade base member to allow the blade member to move integrally in correspondence with pressing force applied to the blades of the blade member when the blades contact a skin surface.

The blade base member preferably has an elastic portion that supports the blade member to allow the blade member to move integrally in correspondence with pressing force applied to the blades of the blade member when the blades contact a skin surface.

With each of the above-described configurations, the elastic portion (an elastic leg portion or an elastic portion) ensures elastic movement of the blade member and decreases resistance to shaving.

DETAILED DESCRIPTION OF THE PREFERRED EMBODIMENTS

A cartridge razor according to a first embodiment will now be described with reference to FIGS. 1 to 8.

Figure 1:
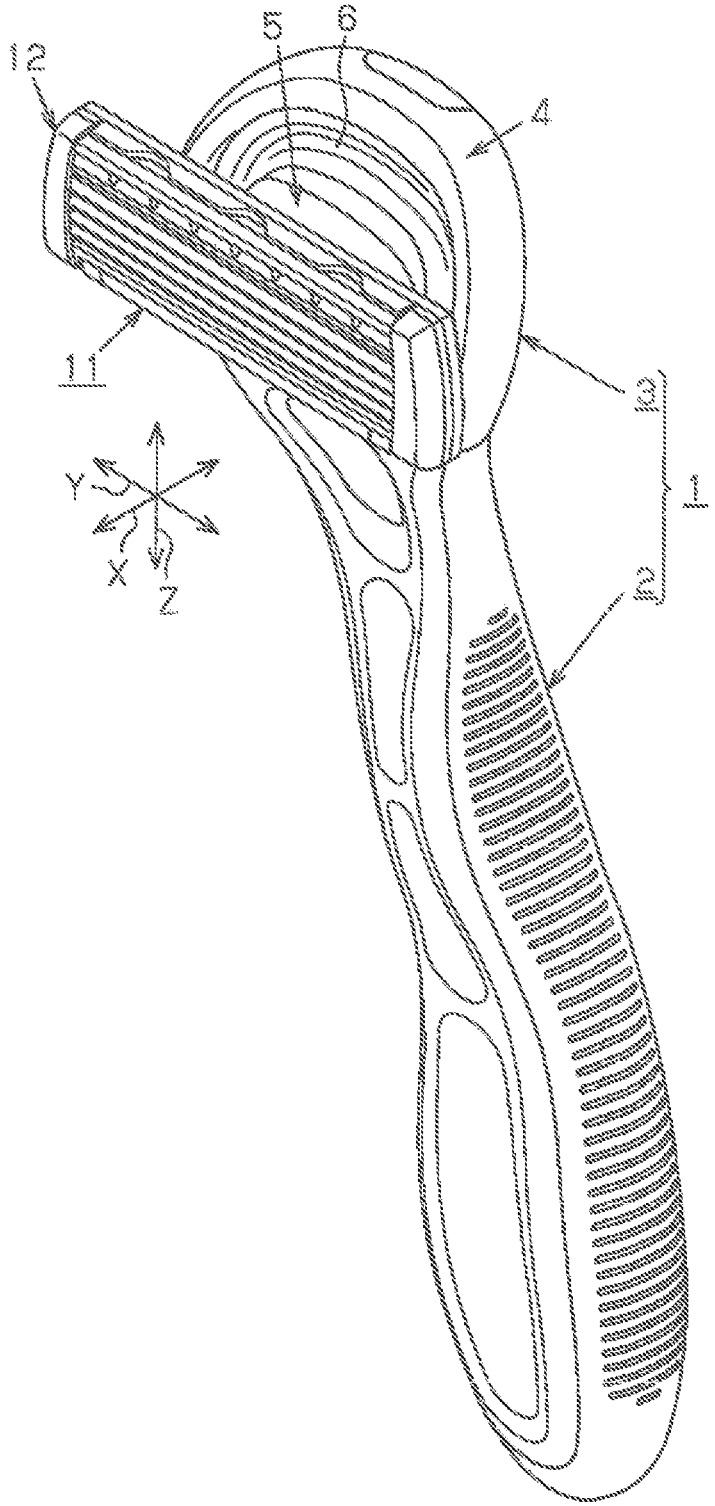
FIG. 1 is a perspective front view showing a cartridge razor according to a first embodiment.

In the cartridge razor, as shown in FIG. 1, a blade cartridge 11 is detachably attached to a holder 1. In the respective drawings, regarding the cartridge razor, the direction in which the blade cartridge 11 approaches or separates from the skin when the razor is in use is defined as an x-axis, the direction in which the cutting edge of the blade cartridge 11 extends is defined as a Y-axis, and the direction in which the holder 1 extends is defined as a z-axis. The x-axis, the y-axis, and the z-axis are perpendicular to one another. In the razor, the side close to the user is defined as a front side or a near side and the side separate from the user is defined as a rear side or a back side.

Figure 3A:
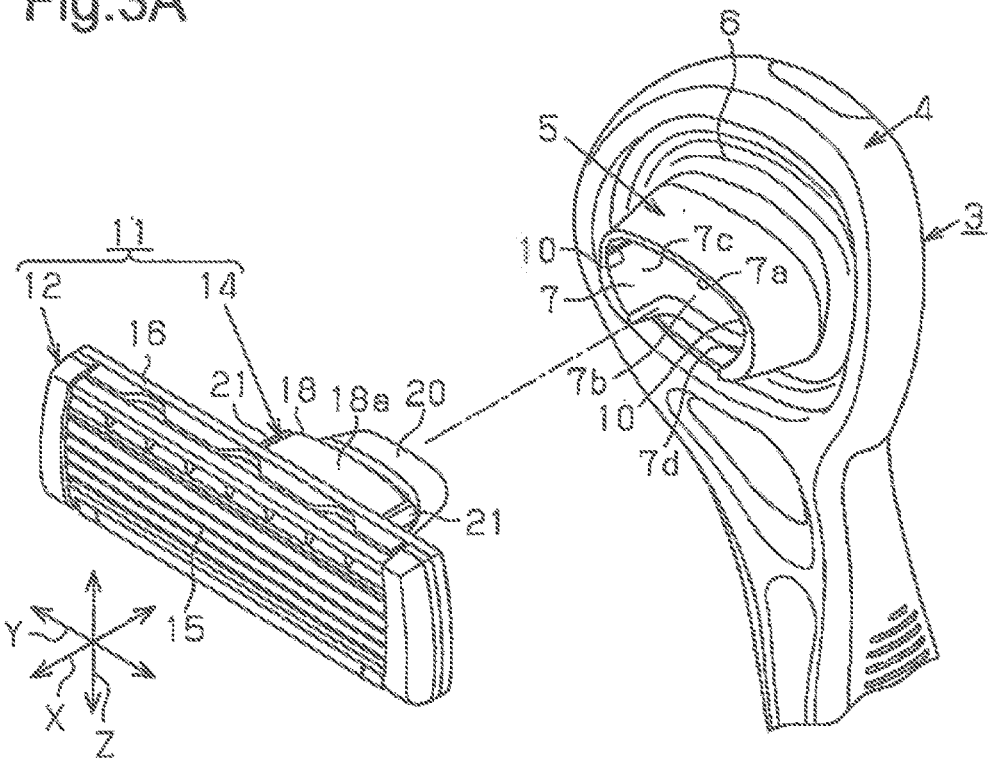
FIG. 3A is an exploded perspective front view showing the cartridge razor of FIG. 1 in a state in which a blade cartridge is detached from the holder.

With reference to FIG. 1, the holder 1 includes a grip portion 2 gripped by the user and a head portion 3 arranged at an upper end of the grip portion 2. As shown in FIG. 3A, an annular supporting portion 4 is formed in the head portion 3. A tubular receiving portion 5 is arranged inside the supporting portion 4 through an elastic plate 6. The receiving portion 5 is formed at a core position of the supporting portion 4 to project toward the front side along the x-axis. Referring to FIG. 4B, a coupling hole 7, which extends along the x-axis, is formed in the receiving portion 5. The coupling hole 7 includes an attachment/detachment port 8, which opens forward, and a manipulation port 9, which opens rearward. As illustrated in FIG. 3A, the coupling hole 7 includes an upper surface 7*a* and a lower surface 7*b* facing each other along the z-axis and a left surface 7*c* and a right surface 7*d* facing each other along the y-axis. The upper surface 7*a* and the lower surface 7*b* are set substantially parallel to each other. The distance between the left surface 7*c* and the right surface 7*d* is set to become greater from the lower surface 7*b* toward the upper surface 7*a*. Restriction grooves 10, each of which extends along the x-axis, are formed in the left surface 7*c* and the right surface 7*d* of the coupling hole 7.

Figure 4A:
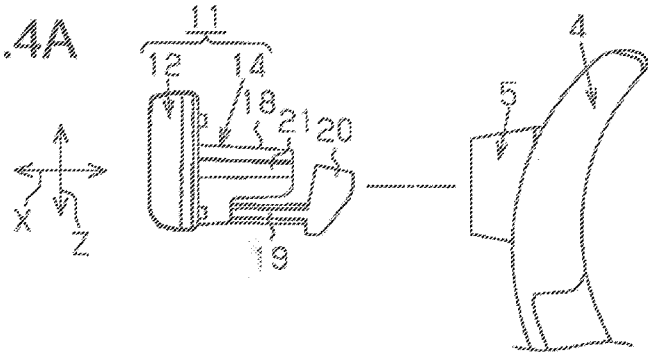
FIG. 4A is an exploded side view showing the cartridge razor of FIG. 3.
Figure 4B:
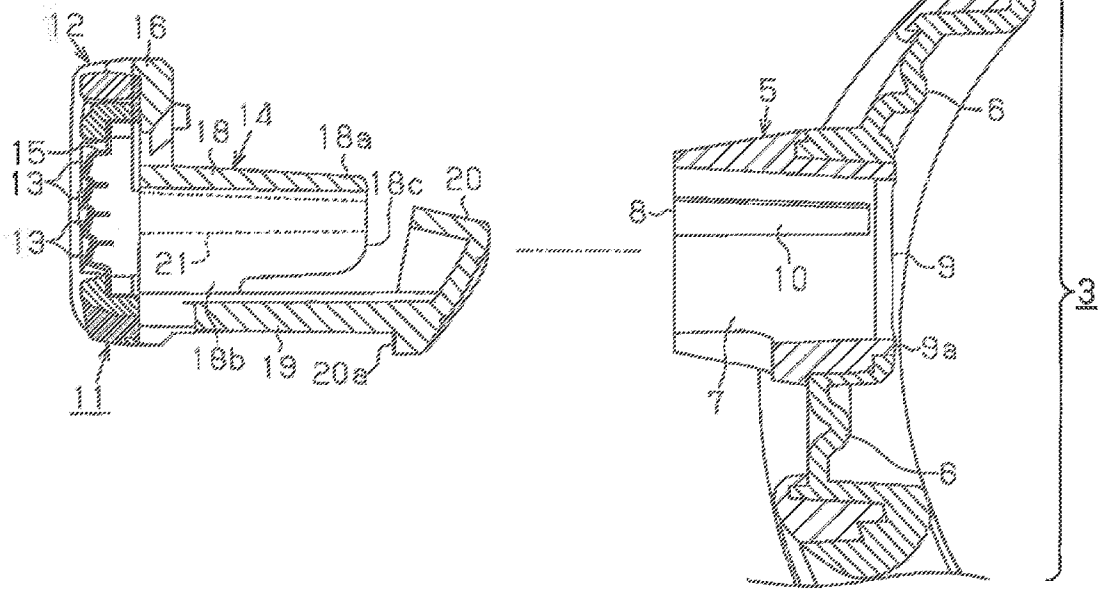
FIG. 4B is an exploded cross-sectional view showing the cartridge razor of FIG. 3.

As shown in FIGS. 4A and 4B, the blade cartridge 11 (the razor head) has a blade assembly 12 and a coupling projection 14. The blade assembly 12 includes a plurality of (four) blades 13, which are located on the near side of the blade assembly 12 and comes into contact with the skin. The coupling projection 14 is coupled to the back side of the blade assembly 12 and extends in a direction separating from the blades 13, or, in other words, rearward. Specifically, referring to FIG. 5, the blade assembly 12 includes a blade member 15, a blade base member 16, and a top member 17. The coupling projection 14 is coupled to the rear surface of the blade base member 16. The top member 17 is formed in a rectangular frame shape. The blade member 15 is held between the blade base member 16 and the top member 17 by being held between the blade base member 16 and the top member 17. Specific configuration of the blade assembly 12 will be described later.

Figure 3B:
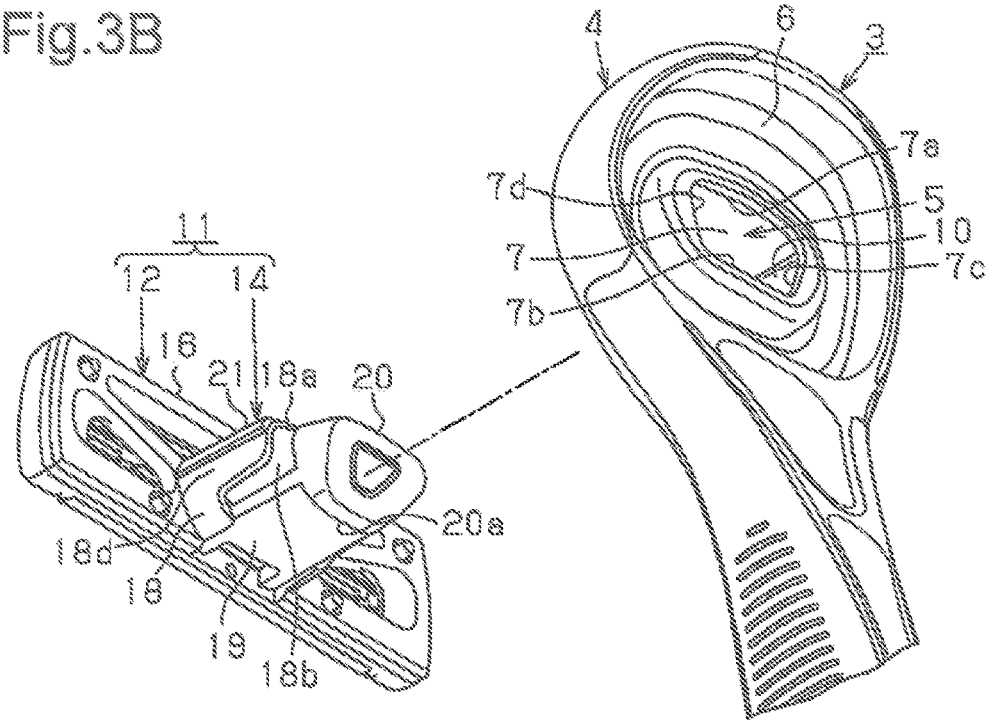
FIG. 3B is an exploded perspective rear view showing the cartridge razor of FIG. 1 in a state in which the blade cartridge is detached from the holder.

With reference to FIGS. 3A, 3B, 4A, and 4B, the coupling projection 14 of the blade cartridge 11 has a guide portion 18, a cantilevered elastic portion 19, and a manipulating portion 20. The guide portion 18 is arranged on the back surface of the blade base member 16 of the blade assembly 12 and extends rearward. The guide portion 18 includes an upper plate portion 18*a*, a left plate portion 18*c*, and a right plate portion 18*d*. The upper plate portion 18*a* extends along the length of the blade assembly 12. The left plate portion 18*c* and the right plate portion 18*d* are connected to the corresponding opposite ends of the upper plate portion 18*a* and each extend along the width of the blade assembly 12. In the guide portion 18, the distance between the left plate portion 18*c* and the right plate portion 18*d* is set to become greater toward the upper plate portion 18*a*. As shown in FIG. 3B, restricting projections 21, which extend along the x-axis, are formed on the outer surface of the left plate portion 18*c* and the outer surface of the right plate portion 18*d*. The elastic portion 19 is formed integrally with the guide portion 18 and arranged on the lower side in the space inside the guide portion 18 on the back surface of the blade base member 16 of the blade assembly 12. The elastic portion 19 is located in an opening of a recess 18*b* of the guide portion 18. The elastic portion 19 is flexible along the z-axis. The manipulating portion 20 is formed integrally with the elastic portion 19 at the distal end of the elastic portion 19. With reference to FIG. 4B, the manipulating portion 20 is formed to extend toward the upper plate portion 18*a* of the guide portion 18 in a direction perpendicular to the extending direction of the elastic portion 19. Referring to FIG. 3B, the manipulating portion 20 is formed substantially in a trapezoidal columnar shape and has a distal surface inclined with respect to the z-axis. As shown in FIG. 4B, a stepped portion 20*a* is formed between the elastic portion 19 and the manipulating portion 20. The stepped portion 20*a* is arranged on the lower side of the boundary portion between the elastic portion 19 and the manipulating portion 20 and includes the surface of the elastic portion 19 extending along the x-axis and the surface of the manipulating portion 20 perpendicular to the aforementioned surface of the elastic portion 19.

A method of using the cartridge razor according to the first embodiment will hereafter be described.

Figure 2B:
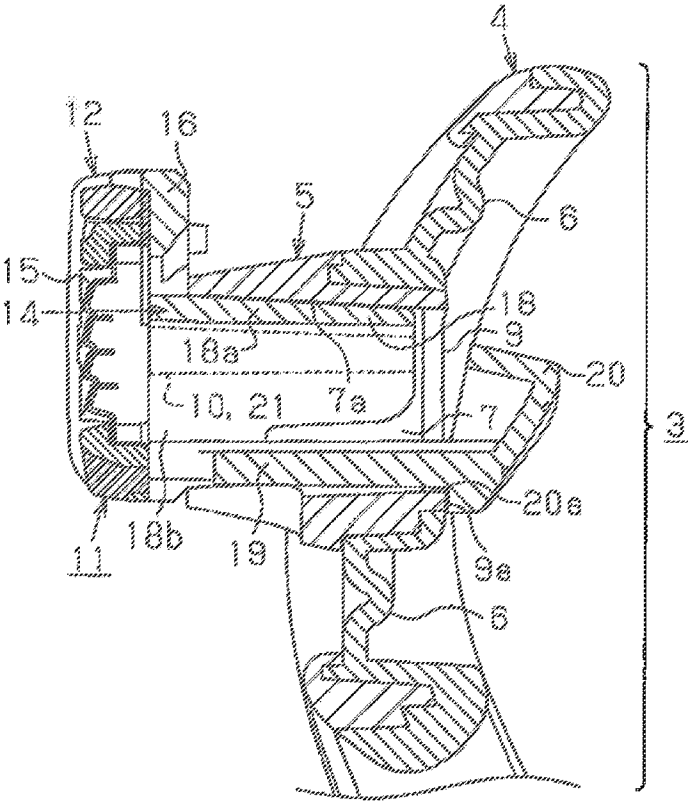
FIG. 2B is a cross-sectional view showing a portion of the cartridge razor of FIG. 1.
Figure 2A:
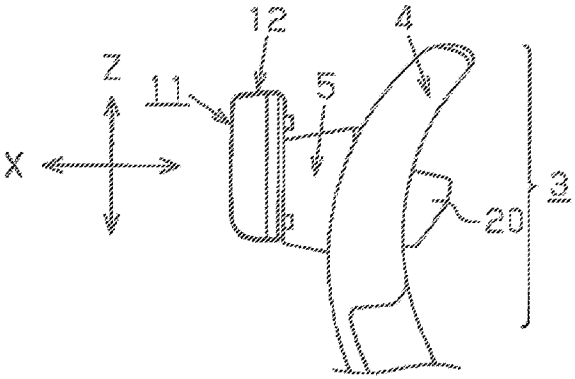
FIG. 2A is a side view showing a portion of the cartridge razor of FIG. 1.

As illustrated in FIGS. 2A, 3A, and 4A, the coupling projection 14 of the blade cartridge 11 is inserted into the coupling hole 7 of the holder 1 through the attachment/detachment port 8. As the guide portion 18 is inserted into the coupling hole 7, the outer surface of the upper plate portion 18*a*, the outer surface of the left plate portion 18*c*, and the outer surface of the right plate portion 18*d* of the guide portion 18 slide on the upper surface 7*a*, the left surface 7*c*, and the right surface 7*d* of the coupling hole 7, respectively. Meanwhile, the restricting projection 21 of the left plate portion 18*c* and the restricting projection 21 of the right plate portion 18*d* of the guide portion 18 move in the restriction groove 10 of the left surface 7*c* and the restriction groove 10 of the right surface 7*d* of the coupling hole 7, respectively. When insertion of the blade cartridge 11 into the holder 1 is complete, a holding state in which the blade cartridge 11 is held by the holder 1 is brought about. In the holding state, the stepped portion 20*a* between the elastic portion 19 and the manipulating portion 20 is locked to a peripheral portion 9*a* of the manipulation port 9 and the receiving portion 5 is clamped between the blade base member 16 of the blade assembly 12 and the stepped portion 20*a*. At this stage, the manipulating portion 20 projects outward from the manipulation port 9 of the coupling hole 7 and is thus exposed to the exterior. When the blade cartridge 11 is pressed against the skin surface to be used in the holding state, the elastic plate 6 warps in correspondence with the direction and intensity of the force applied to the blade cartridge 11. This enables the blade cartridge 11 to swing along the three axes.

For example, when the blade cartridge 11 is arranged in the orientation opposite from the above-described correct orientation of the blade cartridge 11 with respect to the holder 1 and, in this state, is brought close to the holder 1, the outline of the guide portion 18 does not match the shape of the coupling hole 7 and the positions of the restricting projections 21 of the guide portion 18 do not correspond to the positions of the restriction grooves 10 of the coupling hole 7. This hampers insertion of the coupling projection 14 of the blade cartridge 11 into the coupling hole 7 of the holder 1.

To detach the blade cartridge 11 from the holder 1, the manipulation force is applied to an upper section of the manipulating portion 20, which is shown in FIG. 2, from the rear side to the front side of the holder 1. This elastically deforms the elastic portion 19 to separate the stepped portion 20*a* between the elastic portion 19 and the manipulating portion 20 from the peripheral portion 9*a* of the manipulation port 9. In this state, the blade cartridge 11 can be spaced from the holder 1 to detach the blade cartridge 11 from the holder 1.

The configuration of the blade assembly 12 of the blade cartridge 11 will hereafter be described in detail.

Figure 5:
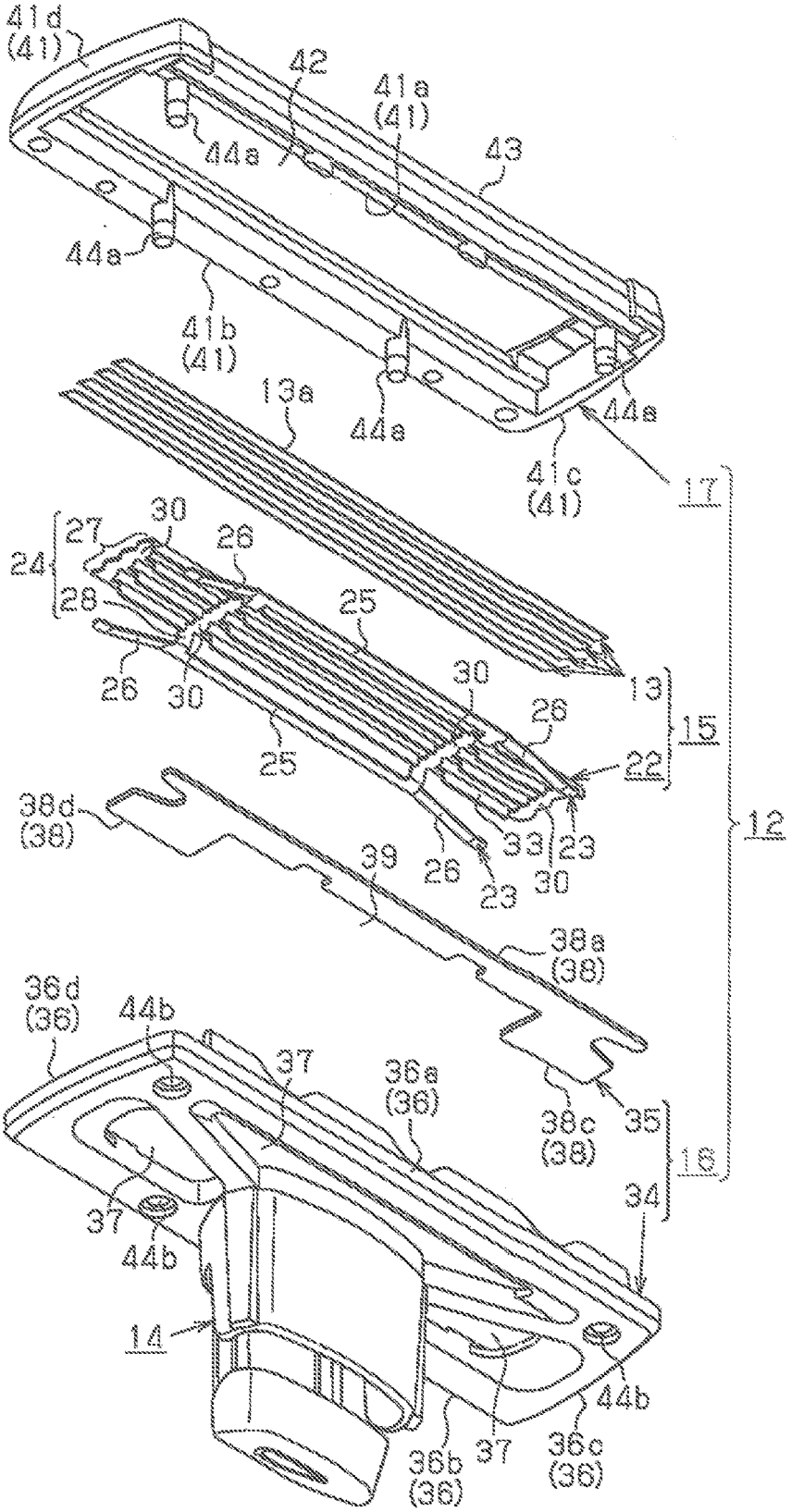
FIG. 5 is an exploded perspective view showing a blade cartridge of the cartridge razor of FIG. 1.

As illustrated in FIG. 5, the blade member 15 includes a seat 22 in addition to the multiple blades 13.

Figure 6A:
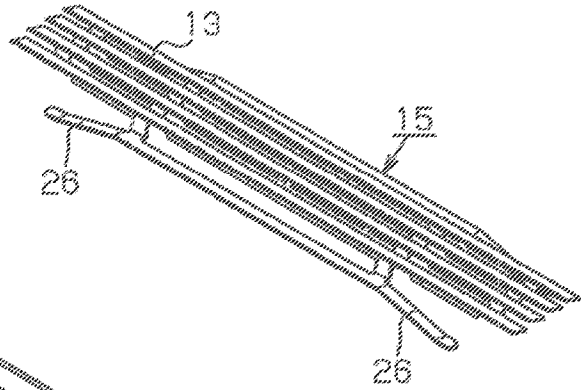
FIG. 6A is a perspective view showing a blade member in which blades are attached to a seat of the blade cartridge of FIG. 5.
Figure 6B:
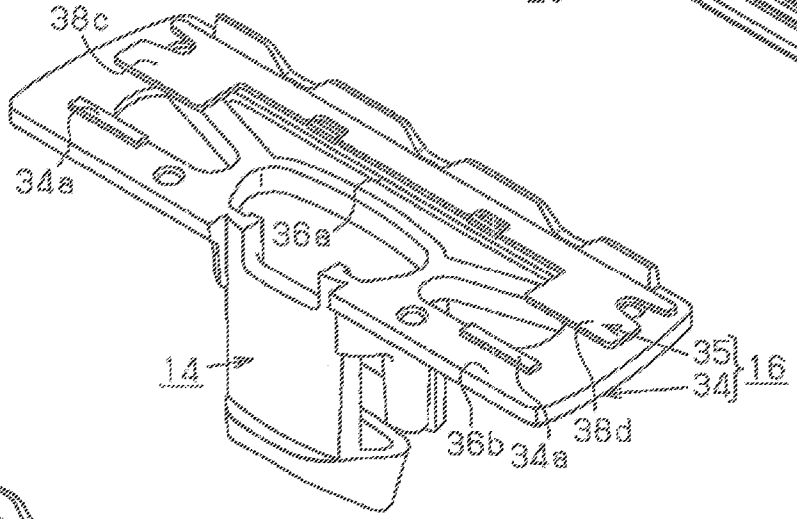
FIG. 6B is a perspective view showing a blade base member in which a base plate is mounted on a bottom base.

The seat 22 is formed by pressing a plate of, for example, austenitic stainless steel. The seat 22 includes mounting bases 23 and a blade supporting portion 24. The mounting bases 23 include four leg plates 26, each of which is an example of an elastic leg portion. Each leg plate 26 extends along the length of the seat 22 to become spaced from the middle of the seat 22. The four leg plates 26 are arranged in the vicinities of the four corner sections of the seat 22, which has a substantially rectangular shape as viewed along the thickness of the seat 22. Each leg plate 26 is arranged in an inclined manner to become spaced from the blade supporting portion 24 toward the distal end of the leg plate 26. With reference to FIG. 6A, the distal end of each leg plate 26 has a linear shape along the length of the seat 22. Referring to FIG. 6B, the distal end of each leg plate 26 is held in contact with the upper surface of the blade base member 16. By means of the four leg plates 26 held in contact with the upper surface of the blade base member 16, the blade supporting portion 24 of the seat 22 is held at a position spaced from the upper surface of the blade base member 16.

Figure 8A:
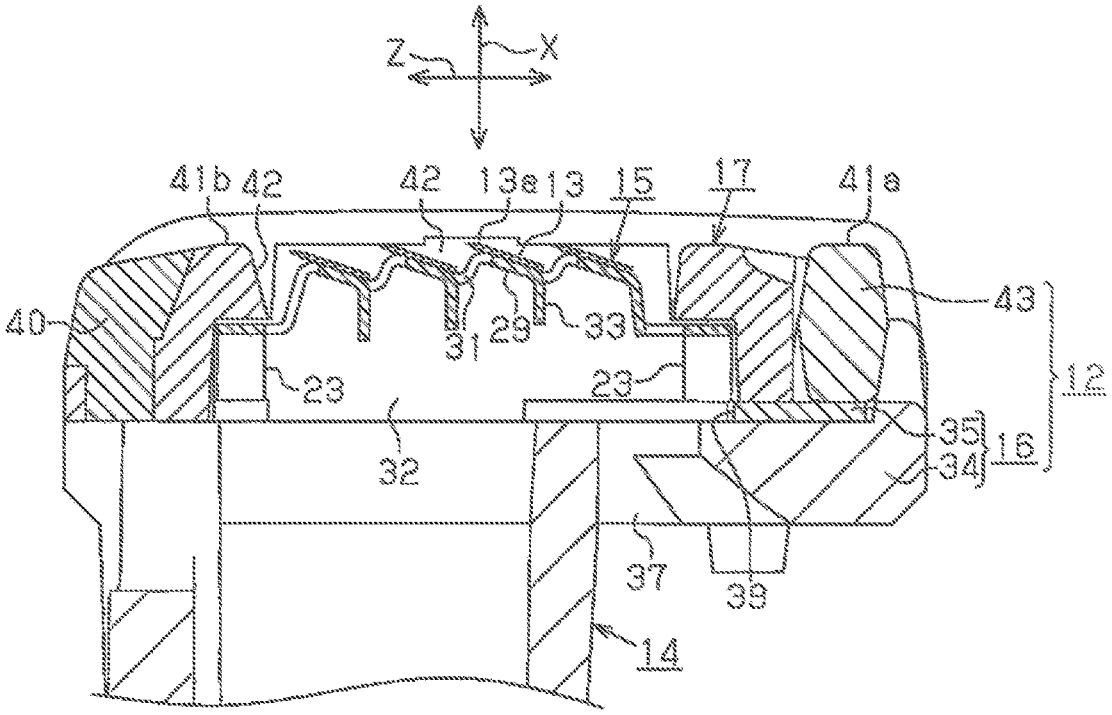
FIG. 8A is an enlarged cross-sectional view taken along line 8*a*-8*a* of FIG. 7D.
Figure 8B:
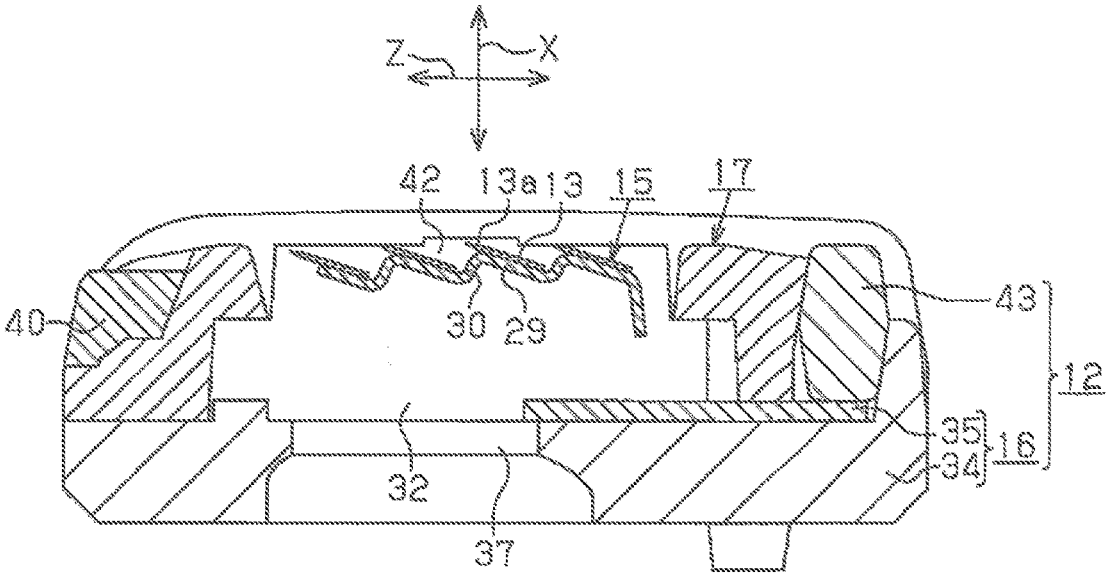
FIG. 8B is an enlarged cross-sectional view taken along line 8*b*-8*b* of FIG. 7D.

As shown in FIGS. 5, 8A, and 8B, the blade supporting portion 24 includes suspending arm portions 28 and a blade attachment plate 27. The blade attachment plate 27 includes a plurality of (four) step plates 29 corresponding to blade mounting portions, reinforcement plate portions 33 corresponding to reinforcement portions, and four bridge portions 30 (coupling portions) that couple the multiple (four) step plates 29 together. The step plates 29 are arranged in a stepped manner along the width of the seat 22. As illustrated in FIG. 8A, each of the reinforcement plate portions 33 is configured in a bending manner with respect to the corresponding step plate 29. Each reinforcement plate portion 33 is bent from the corresponding step plate 29 toward the inner side of the blade assembly 12. The step plates 29, the reinforcement plate portions 33, and the bridge portions 30 are formed integrally with one another. Each step plate 29 and each reinforcement plate portion 33 are formed substantially in an L-shape to define an obtuse angle, which is, for example, approximately 108 degrees, when the blade attachment plate 27 is cut along the width. The reinforcement plate portions 33 extend along the thickness of the seat 22. The step plates 29 are inclined with respect to the width of the seat 22. Specifically, each step plate 29 is inclined forward from the basal end of the corresponding reinforcement plate portion 33 to become spaced from the blade base member 16. The step plates 29 are located at equal heights along the thickness of the seat 22. With reference to FIGS. 5 and 8B, the bridge portions 30 (the coupling portions) extend in the arrangement direction of the step plates 29. The four bridge portions 30 are spaced apart along the length of each step plate 29. The two of the four bridge portions 30 that are located at the opposite ends of the blade supporting portion 24 correspond to the opposite ends of the seat 22 in the longitudinal direction. A through hole 31 (a shaving scum removal hole) is formed between each adjacent pair of the step plates 29. The through holes 31 each have an elongated rectangular shape extending along the length of the seat 22 and are arranged along the width of the seat 22. Each of the through holes 31 is divided by the bridge portions 30 along the length of the through hole 31. As a result, along the length of the seat 22, three sections of each through hole 31 are arranged for the corresponding blade 13. The through holes 31 are formed when the reinforcement plate portions 33 are bent from the plate used to form the seat 22. That is, the area of each through hole 31 is equal to the area of the corresponding reinforcement plate portion 33. With reference to FIG. 8A, a hollow 32 (a shaving scum removal hole), which is arranged in the inner sides of the mounting bases 23, communicates with the exterior through the through holes 31. As shown in FIG. 5, the suspension arm portions 28 couple the blade attachment plate 27 to the upper and lower mounting bases 23 together. Specifically, two of the four suspension arm portions 28 are coupled to first ends of the two of the bridge portions 30 located in the middle in the longitudinal direction of the seat 22. The other two of the four suspension arm portions 28 are coupled to second ends of the aforementioned two bridge portions 30.

With reference to FIGS. 8A and 8B, the blades 13, which are made of metal such as martensitic stainless steel, are arranged on the upper surfaces of the corresponding step plates 29 of the blade attachment plate 27. Each blade 13 is fixed to the corresponding step plate 29 through a plurality of spot welding portions. It is preferable that the reinforcement plate portions 33 be arranged in the blade arrangement direction (along the z-axis) with respect to the spot welding portions. The blades 13 are arranged on the blade attachment plate 27 in a stepped manner. Each through hole 31 is located on the inner side of the cutting edge 13*a* of the corresponding blade 13.

As illustrated in FIG. 5, the blade base member 16 is configured by a bottom base 34 made of plastic and a base plate 35 made of aluminum. The aforementioned coupling projection 14 is coupled to the back surface of the bottom base 34. The bottom base 34 includes a rectangular frame portion 36. The frame portion 36 includes an upper frame section 36*a*, a lower frame section 36*b*, a left frame section 36*c*, and a right frame section 36*d*. The upper frame section 36*a* and the lower frame section 36*b* extend along the length of the bottom base 34 and are spaced apart along the width of the bottom base 34. The left frame section 36*c* and the right frame section 36*d* extend along the width of the bottom base 34 to couple the upper frame section 36*a* and the lower frame section 36*b* together at the opposite ends of the upper and lower frame sections 36*a*, 36*b*. The upper frame section 36*a* and the lower frame section 36*b* are elongated compared to the left frame section 36*c* and the right frame section 36*d*. The frame portion 36 includes a first inclined frame section that couples a boundary portion between the upper frame section 36*a* and the right frame section 36*d* to the coupling projection 14 and a second inclined frame section that couples the boundary portion between the upper frame section 36*a* and the left frame section 36*c* to the coupling projection 14. The region surrounded by the frame sections 36*a* to 36*d* is divided by the first and second inclined frame sections into three shaving scum removal holes 37. A positioning hole 44*b*, which extends through the bottom base 34 along the thickness, is formed in the boundary portion between the upper frame section 36*a* and the right frame section 36*d*. Another positioning hole 44*b*, which extends through the bottom base 34 along the thickness, is formed in the boundary portion between the upper frame section 36*a* and the left frame section 36*c*. Another pair of positioning holes 44*b*, each of which extends through the bottom base 34 along the thickness, is formed in the lower frame section 36*b*. The two positioning holes 44*b* in the lower frame section 36*b* are located in the vicinity of a middle section of the bottom base 34 compared to the positioning holes 44*b* in the aforementioned boundary portions.

The base plate 35 includes an upper frame section 38*a* extending along the length of the base plate 35, a left frame section 38*c* extending along the width of the base plate 35 from the left end of the upper frame section 38*a*, and a right frame section 38*d* extending along the width of the base plate 35 from the right end of the upper frame section 38*a*. That is, the base plate 35 has a substantially U-shape and forms a cutout 39. Referring to FIG. 6B, the base plate 35 is mounted on the upper surface of the upper frame section 36*a* of the bottom base 34. The cutout 39 of the base plate 35 is located over the corresponding shaving scum removal hole 37 between the first and second inclined frame sections in the bottom base 34. This shaving scum removal hole 37 and the cutout 39 communicate with each other.

As illustrated in FIG. 5, the top member 17 is made of plastic and includes a rectangular frame portion 41. The frame portion 41 includes an upper frame section 41*a*, a lower frame section 41*b*, a left frame section 41*c*, and a right frame section 41*d*. The upper frame section 41*a* and the lower frame section 41*b* extend along the length of the top member 17 and are spaced apart along the width of the top member 17. The left frame section 41*c* and the right frame section 41*d* extend along the width of the top member 17 to connect the upper frame section 41*a* and the lower frame section 41*b* together at the opposite ends of the upper and lower frame sections 41*a*, 41*b*. The upper frame section 41*a* and the lower frame section 41*b* are elongated compared to the left frame section 41*c* and the right frame section 41*d*. A blade exposing hole 42 is formed in the region surrounded by the frame sections 41*a* to 41*d*. With reference to FIG. 7D, a shaving aid 40, which comes into contact with the skin, is mounted on the upper surface of the lower frame section 41*b* of the top member 17. Referring to FIG. 7B, two positioning shafts 44*a*, which project toward the blade base member 16, are arranged on an inner surface of the upper frame section 41*a*. The two positioning shafts 44*a* are located at the opposite ends of the upper frame section 41*a*. Similarly, another two positioning shafts 44*a* are arranged on an inner surface of the lower frame section 41*b*. The two positioning shafts 44*a* of the upper frame section 41*a* are arranged at positions close to the middle section of the top member 17 in the longitudinal direction compared to the two positioning shafts 44*a* of the lower frame section 41*b*.

With reference to FIG. 5, with the blade member 15 arranged between the blade base member 16 and the top member 17, the frame portion 36 of the bottom base 34 and the frame portion 41 of the top member 17 are placed over each other. At this stage, the positioning shafts 44*a* of the top member 17 are engaged with the corresponding positioning holes 44*b* of the bottom base 34. The top member 17 is thus positioned with respect to the bottom base 34. In this manner, the blade base member 16 and the top member 17 are joined together.

Figure 6C:
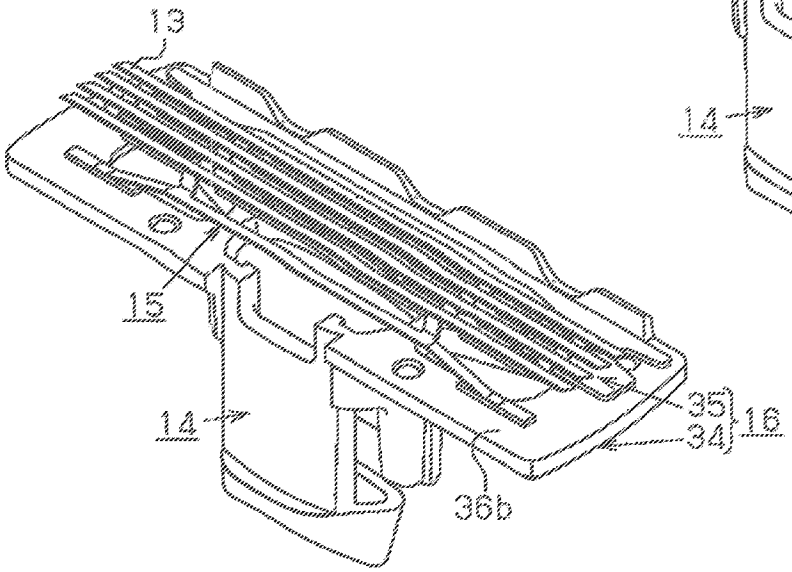
FIG. 6C is a perspective view showing a state in which the seat of the blade member is mounted on the base plate of the blade base member.

Referring to FIGS. 6A to 6C, in the blade cartridge 11, two of the four leg plates 26 of the seat 22 are arranged on the upper surfaces of the corresponding left and right frame sections 38*c*, 38*d* of the base plate 35. The other two of the four leg plates 26 are mounted on the upper surface of the lower frame section 36*b*. A buffer member 34*a*, which is made of metal or plastic, is arranged between the upper surface of the lower frame section 36*b* and the corresponding two leg plates 26.

Figure 7C:
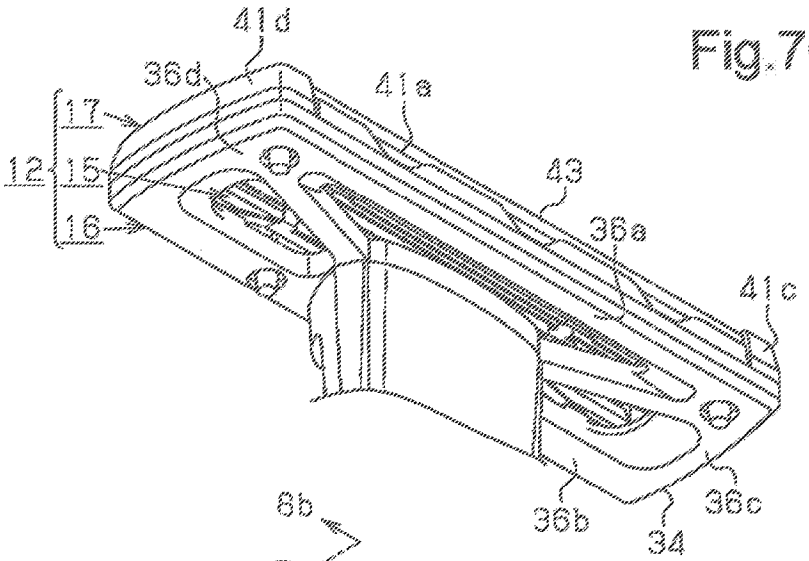
FIGS. 7C and 7D are perspective views each showing the blade cartridge of FIG. 5 as a whole.
Figure 7D:
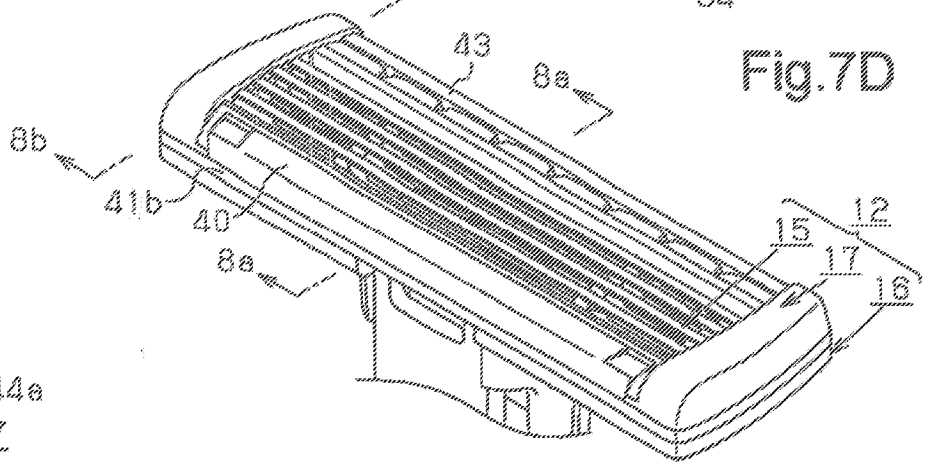

With reference to FIGS. 7C and 7D, the mounting bases 23 of the seat 22 are arranged in the space between the upper and lower frame sections 36*a*, 36*b* of the bottom base 34 and the upper and lower frame sections 41*a*, 41*b* of the top member 17 to be hidden from the exterior. The opposite ends of each blade 13, which is supported by the blade supporting portion 24, are located between the left and right frame sections 36*c*, 36*d* of the bottom base 34 and the left and right frame sections 41*c*, 41*d* of the top member 17. The opposite ends of each blade 13 are urged toward the inner surfaces of the corresponding left and right frame sections 41*c*, 41*d* of the top member 17 by the urging force of the leg plates 26.

As shown in FIG. 8A, the cutting edge 13*a* of each blade 13 is located in the vicinity of a skin contact surface that extends continuously from the front surfaces of the upper and lower frame sections 41*a*, 41*b* of the top member 17. The blades 13 are movable integrally, together with the blade supporting portion 24, in a direction perpendicular to the skin contact surface against elastic force of the mounting bases 23.

With reference to FIG. 8A, the hollow 32 (which is a shaving scum removal hole), which is located at the inner side of the seat 22, communicates with the exterior from the back surface of the blade assembly 12 through the cutout 39 of the base plate 35 and the shaving scum removal holes 37 of the bottom base 34 of the blade base member 16. The hollow 32 of the seat 22 communicates with the exterior from the front surface of the blade assembly 12 through the through holes 31 and the blade exposing hole 42 of the top member 17.

A method of assembling the blade cartridge 11 will hereafter be described.

Figure 7A:
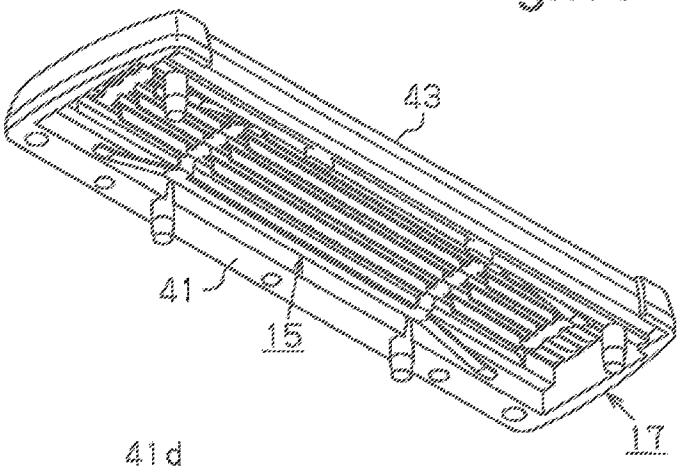
FIG. 7A is a perspective view showing a state in which the blade member is received in the top member of the blade cartridge of FIG. 5.
Figure 7B:
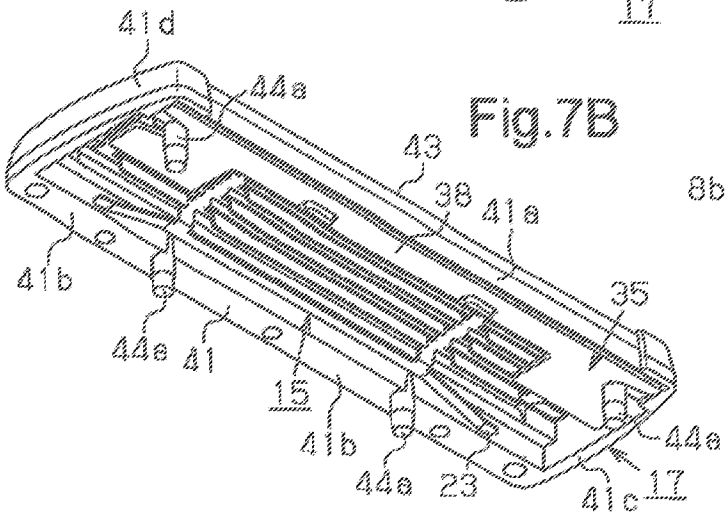
FIG. 7B is a perspective view showing a state in which the blade member and the base plate are received in the top member.

First, as illustrated in FIG. 7A, the blade member 15 is placed over the inner side of the top member 17, to which a shaving aid 43 is attached. Then, referring to FIG. 7B, the base plate 35 is placed over the blade member 15. Subsequently, with reference to FIG. 7C, the bottom base 34 is placed over the base plate 35 and the bottom base 34 is coupled to the top member 17. In this manner, assembly of the blade cartridge 11 is completed.

Operation of the cartridge razor, which is configured as has been described, will now be described.

When the user uses the razor with the front surface of the top member 17 and the blades 13 held in contact with the skin surface, the pressing force applied from the skin surface to the blades 13 elastically warps the two mounting bases 23, particularly the leg portions 26, between the blade base member 16 and the top member 17. This moves the seat 22 integrally with the blades 13 on the step plates 29. In the first embodiment, by means of the reinforcement plate portions 33, which are formed in the blade attachment plate 27, the rigidity of each step plate 29 is set high. The pressing force applied from the skin surface acts on each reinforcement plate portion 33 in a direction perpendicular to the thickness direction of the reinforcement plate portion 33. This hampers deformation of the reinforcement plate portions 33 caused by the pressing force applied from the skin surface. The step plates 29, to which the reinforcement plate portions 33 are coupled, thus resist deformation. In this manner, by improving the rigidity of the blade attachment plate 27, the relative positions of the blades 13 are maintained regardless of the pressing force applied from the skin surface. In contrast, in the conventional configuration in which a blade attachment plate is formed without a reinforcement plate portion, the blade attachment plate is shaped as a flat plate. In this configuration, the pressing force applied from the skin surface acts on the upper surface of the flat plate in a direction perpendicular to the upper surface of the flat plate. The blade attachment plate thus tends to be bent and deformed by the pressing force applied from the skin surface.

In the blade member 15, shaving scum produced by the blades 13 enters the hollow 32 from the blade exposing hole 42 of the top member 17 through the through holes 31 of the blade attachment plate 27. The shaving scum is then discharged to the exterior via the shaving scum removal holes 37 of the bottom base 34.

Figure 9A:
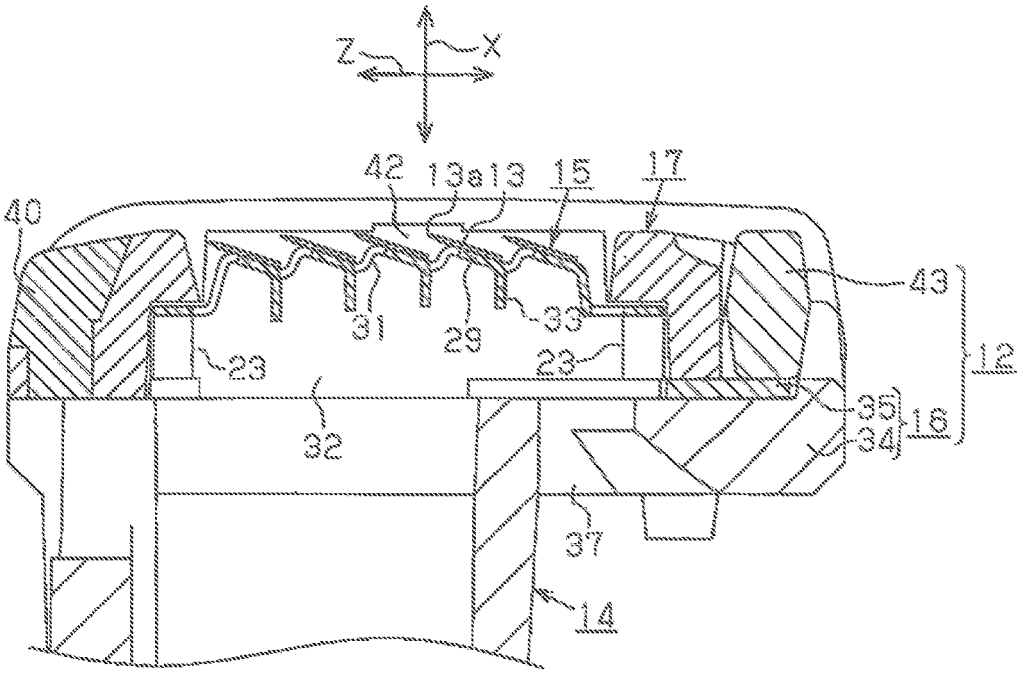
FIG. 9A is an enlarged cross-sectional view corresponding to FIG. 8A, showing a blade cartridge of a cartridge razor according to a second embodiment.
Figure 9B:
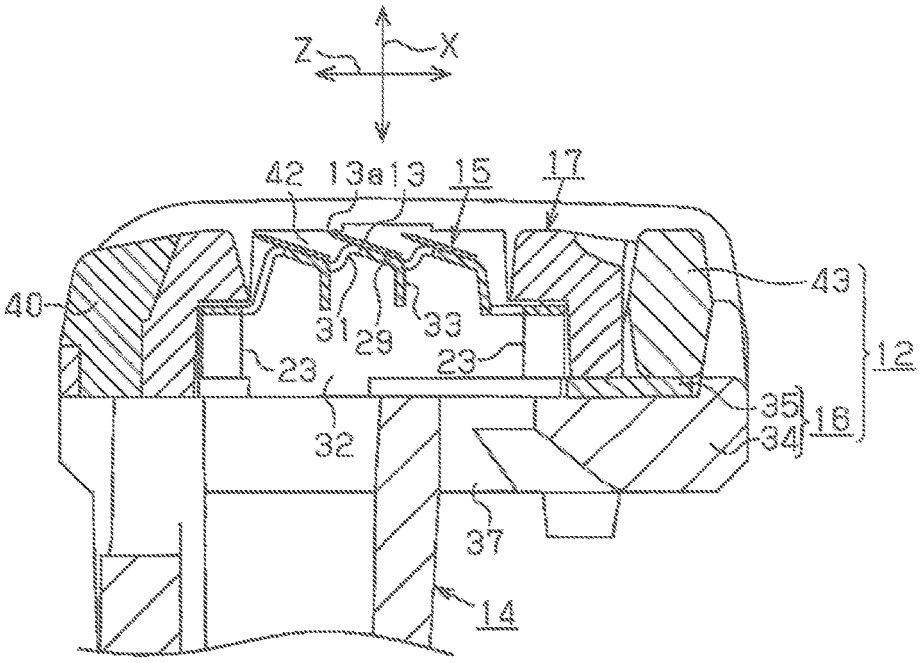
FIG. 9B is an enlarged cross-sectional view corresponding to FIG. 8A, showing a blade cartridge of a cartridge razor according to a third embodiment.

In a second embodiment, as illustrated in FIG. 9A, five blades 13 are employed. In a third embodiment, as shown in FIG. 9B, three blades 13 are employed. In correspondence with these changes, the shape of the seat 22 is modified, or, in other words, the numbers of the step plates 29, the reinforcement plate portions 33, and the through holes 31 of the blade attachment plate 27 are changed. Also, since the size of the seat 22 is changed, the sizes of the blade base member 16 and the top member 17 are changed correspondingly. The second and third embodiments are configured substantially identical with the first embodiment, except for the aforementioned differences, and have the same advantages as the first embodiment.

A cartridge razor according to a fourth embodiment of the present invention will hereafter be described with reference to FIGS. 10 to 14. FIGS. 10, 12, 13 and 14 of the fourth embodiment correspond to FIGS. 5, 6, 7, and 8 of the first embodiment, respectively.

Figure 10:
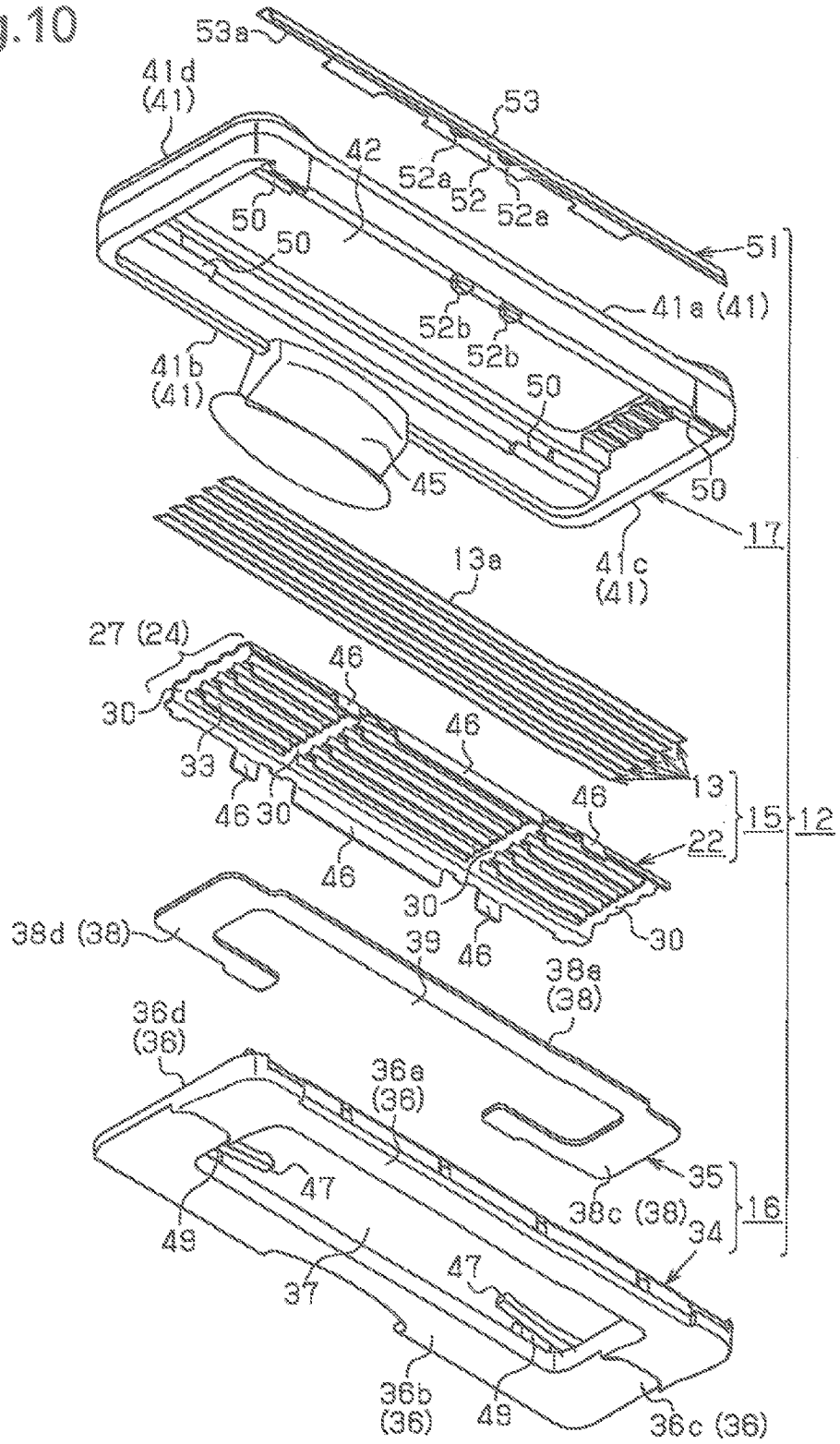
FIG. 10 is an exploded perspective view showing a blade cartridge of a cartridge razor according to a fourth embodiment.
Figures 13A, 13B, 13C, 13D:
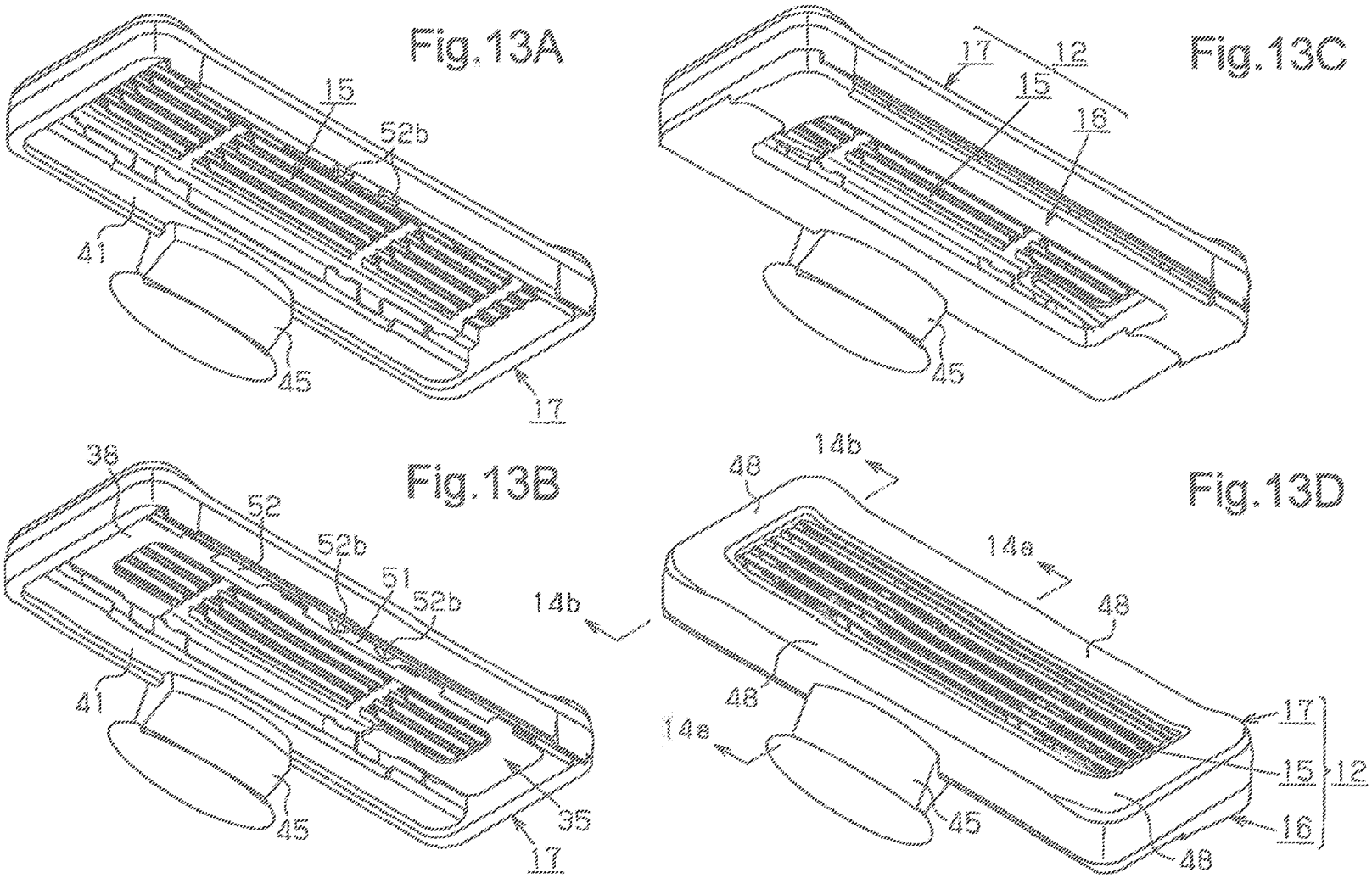
FIG. 13A is a perspective view showing a state in which the blade member is received in the top member of the blade cartridge of FIG. 10.
FIG. 13B is a perspective view showing a state in which the blade member and the base plate are received in the top member.
FIGS. 13C and 13D are perspective views each showing the blade cartridge of FIG. 10 as a whole.

As illustrated in FIGS. 13C and 13D, the blade cartridge 11 (the razor head) has the blade assembly 12 and a coupling projection 45. When the blade assembly 12 is in an assembled state, the coupling projection 45 is arranged between the rear surface of the blade assembly 12 and the side surface of the blade assembly 12 extending along the length. The coupling projection 45 extends rearward from the blade assembly 12. With reference to FIG. 10, a plurality of (five) main blades 13 are assembled with the blade assembly 12 at the near side of the blade assembly 12. In the fourth embodiment, the form of the coupling projection 45 and the form of a holder (not shown) to which the coupling projection 45 is coupled are different from the forms of the corresponding components of the first embodiment.

The blade member 15 has a plurality of (five) main blades 13 and one seat 22. The blade member 15 is held between the blade base member 16 and the top member 17. In the fourth embodiment, the forms of the blade member 15, the blade base member 16, and the top member 17 are also different from the forms of the corresponding components of the first embodiment.

With reference to FIG. 10, the seat 22 of the blade member 15 is formed as an integral body by pressing a plate made of metal such as austenitic stainless steel. The seat 22 is configured by a plurality of leg portions 46 and the blade supporting portion 24. The leg portions 46 are arranged on the opposite sides of the blade supporting portion 24 in the width direction and are bent substantially at a right angle toward the blade base member 16 with respect to the blade supporting portion 24. Each three of the leg portions 46 are arranged in the corresponding peripheral portion of the blade supporting portion 24 extending along the length. The middle one of the three leg portions 46 is elongated compared to the other two of the leg portions 46. The blade supporting portion 24 is supported by the leg portions 46. The leg portions 46 are formed integrally with the blade supporting portion 24. In the fourth embodiment, the leg portions 46 of the seat 22 are non-elastic and thus different from the corresponding components of the first embodiment in this regard.

Figure 14A:
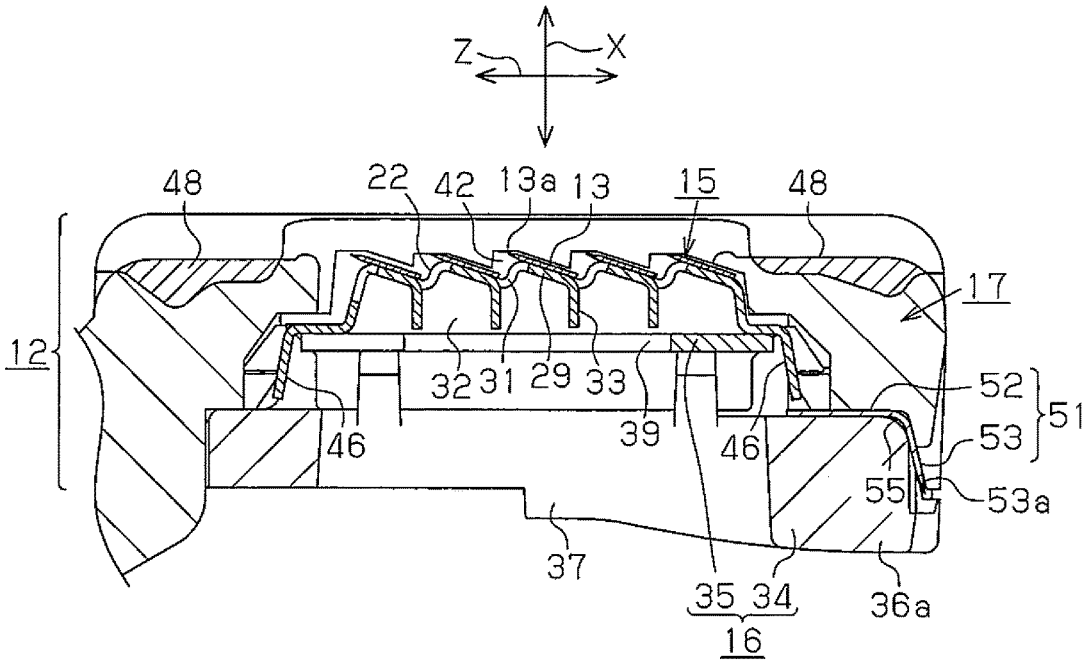
FIG. 14A is an enlarged cross-sectional view taken along line 14*a*-14*a* of FIG. 13D.
Figure 14B:
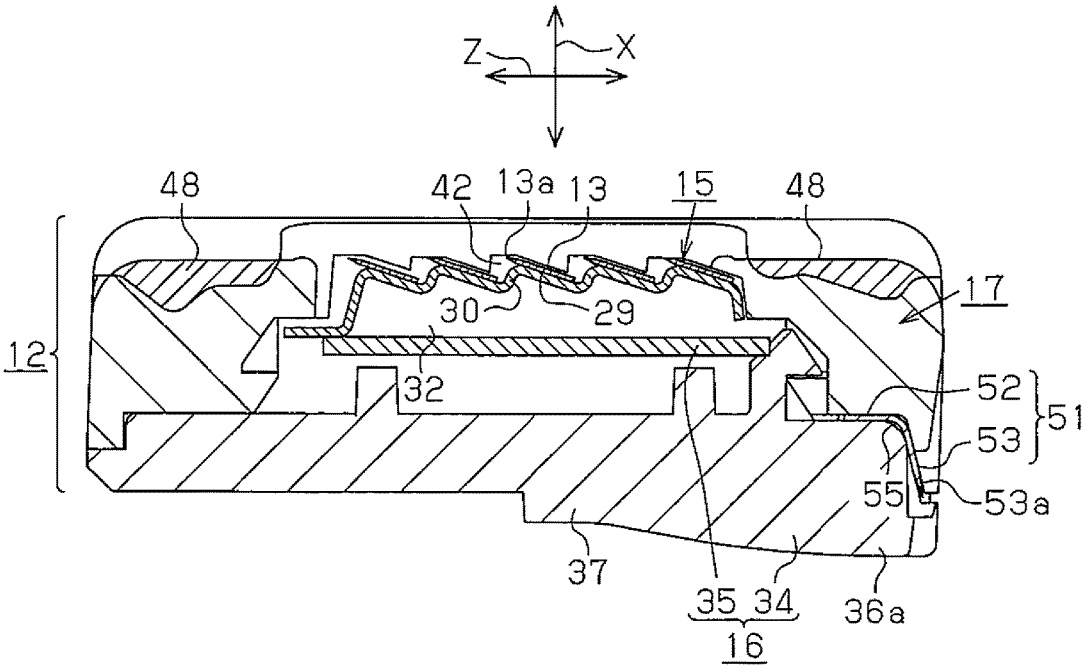
FIG. 14B is an enlarged cross-sectional view taken along line 14*b*-14*b* of FIG. 13D.

Referring to FIGS. 14A and 14B, a plurality of (five) step plates 29 serving as blade mounting portions, which extend along the length of the seat 22, are formed in the seat 22. The step plates 29 are arranged along the width of the seat 22 in a stepped manner. As shown in FIG. 10, four bridge portions 30 (four coupling portions), which each extend in a direction perpendicular to the extending direction of each step plate 29, are arranged on the blade attachment plate 27 of the seat 22. The four bridge portions 30 are spaced apart in the extending direction of each step plate 29. The two of the four bridge portions 30 that are located at the opposite ends correspond to the opposite ends of the seat 22 in the longitudinal direction. The bridge portions 30 couple the step plates 29 together. Each through hole 31 (which is a shaving scum removal hole) is formed between the corresponding adjacent pair of the step plates 29. The through holes 31 each extend along the length of the seat 22. As shown in FIG. 10, the through holes 31 are arranged on the opposite sides of the seat 22 in the longitudinal direction with respect to the bridge portions 30. Referring to FIG. 14A, the hollow 32 (which is a shaving scum removable hole), which is arranged on the inner side of the seat 22, is open to the exterior of the top member 17 through the through holes 31.

To form each of the through holes 31, cuts are formed in the blade attachment plate 27 in accordance with the shape of a rectangle defining the outline of the through hole 31 except for one of the long sides. The cut portions of the blade attachment plate 27 are each bent to define a substantially L-shaped cross section from the corresponding step plate 29 toward the blade base member 16. In this manner, the reinforcement plate portions 33 (the reinforcement portions) are formed between the corresponding step plates 29 and the blade base member 16 one by one for each one of the through holes 31. The angle between each step plate 29 and the corresponding reinforcement plate portion 33 is, for example, approximately 108 degrees. The reinforcement plate portions 33 correspond to the through holes 31 and each extend in the extending direction of the cutting edge 13*a* of the corresponding main blade 13.

As shown in FIGS. 14A and 14B, the blades 13, which are identical with those of the first embodiment, are arranged on the upper surfaces of the step plates 29 of the blade attachment plate 27. Each blade 13 is fixed to the corresponding step plate 29 through a plurality of spot welding portions. It is preferable that the reinforcement plate portions 33 be arranged in the blade arrangement direction. The blades 13 are arranged on the blade attachment plate 27 in a stepped manner.

Figures 12A, 12B, 12C, 12D:
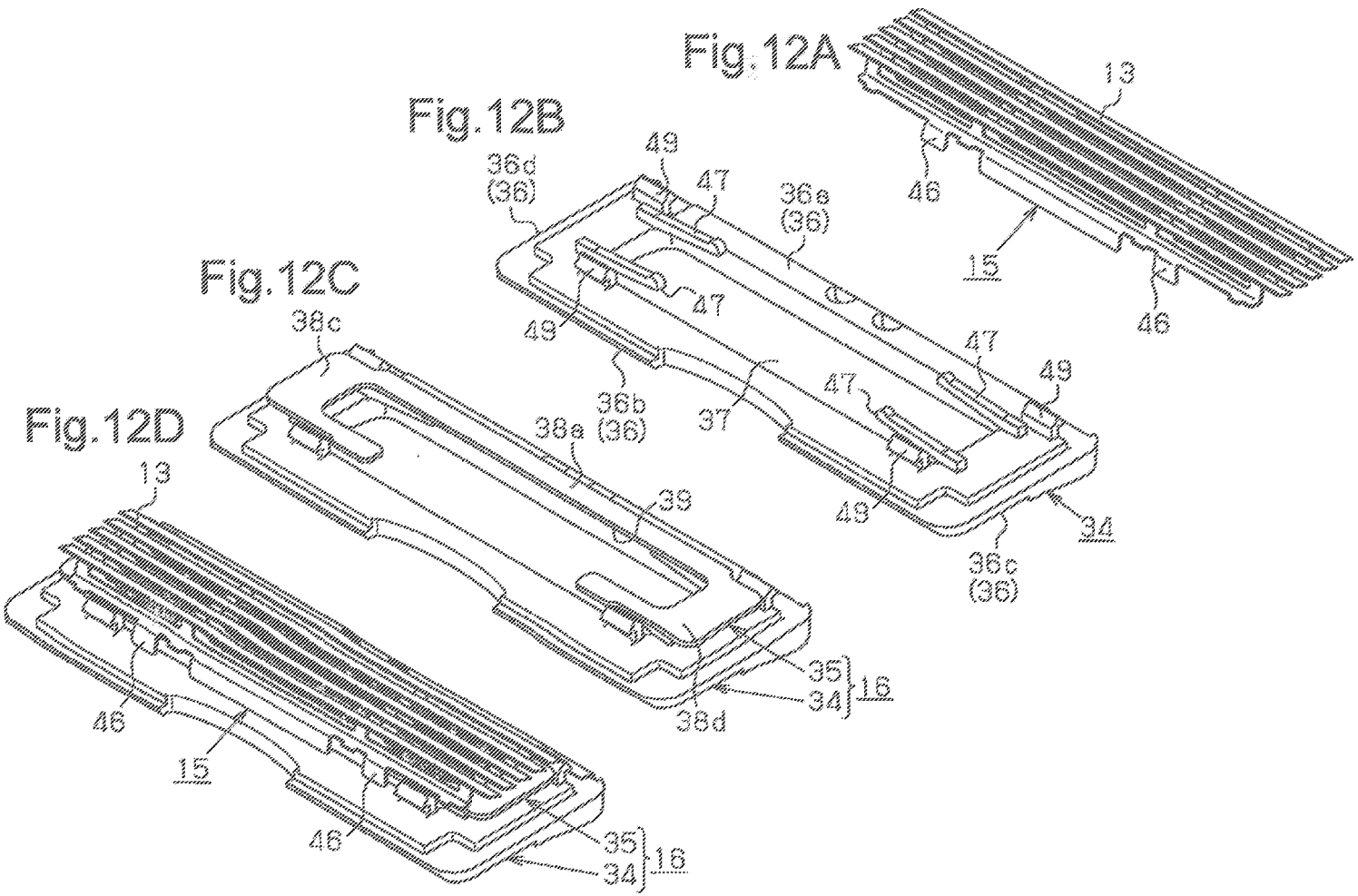
FIG. 12A is a perspective view showing a blade member in which blades are attached to a seat of the blade cartridge of FIG. 10.
FIG. 12B is a perspective view showing a bottom base.
FIG. 12C is a perspective view showing a blade base member in which a base plate is mounted on the bottom base.
FIG. 12D is a perspective view showing a state in which the seat of the blade member is mounted on the base plate of the blade base member.

With reference to FIGS. 12B and 12C, the blade base member 16 is configured by the bottom base 34 made of plastic and the base plate 35 made of aluminum. The bottom base 34 includes the rectangular frame portion 36. The frame portion 36 includes the upper frame section 36*a*, the lower frame section 36*b*, the left frame section 36*c*, and the right frame section 36*d*. The upper frame section 36*a* and the lower frame section 36*b* each extend along the length of the bottom base 34 and are spaced apart along the width of the bottom base 34. The left frame section 36*c* and the right frame section 36*d* each extend along the width of the bottom base 34 such that the upper frame section 36*a* and the lower frame section 36*b* extend continuous from each other at the opposite ends of the upper and lower frame sections 36*a*, 36*b*. The shaving scum removal hole 37 is formed in the region surrounded by the frame sections 36*a* to 36*d*. Referring to FIG. 12B, four cantilevered bar spring portions 47 (elastic portions) and four locking projections 49 are formed on the upper surface of the bottom base 34. The bar spring portions 47 and the locking projections 49 are formed integrally with the frame portion 36. The bar spring portions 47 are located in correspondence with the four corners of the removal hole 37 and each extends along the length of the bottom base 34 toward the middle section of the bottom base 34. Each of the bar spring portions 47 is inclined to become spaced from the frame portion 36 from the basal end toward the distal end of the bar spring portion 47. As viewed along the thickness of the bottom base 34, the basal end of each bar spring portion 47 is placed over an inner peripheral section of the removal hole 37 and the portion of the bar spring portion 47 extending from the basal end toward the distal end is located over the removal hole 37. The four locking projections 49 are located in correspondence with the bar spring portions 47. In the width direction of the bottom base 34, each two of the bar spring portions 47 are located between the corresponding two of the locking projections 49. The distal end of each locking projection 49 is bent outward along the width of the bottom base 34.

The base plate 35 is formed substantially in a C-shape using a flat plate. Specifically, the base plate 35 includes the upper frame section 38*a*, the left frame section 38*c*, and the right frame section 38*d*. The upper frame section 38*a* extends along the length of the base plate 35. The left frame section 38*c* extends along the width of the base plate 35 from the left end of the upper frame section 38*a*. The distal end of the left frame section 38*c* is bent inward substantially at a right angle. The right frame section 38*d* extends along the width of the base plate 35 from the right end of the upper frame section 38*a*. The distal end of the right frame section 38*d* is bent inward substantially at a right angle. The right frame section 38*d* and the left frame section 38*c* are each formed substantially in an L-shape. The cutout 39 is formed in the base plate 35. The base plate 35 is mounted on the upper surface of the upper frame section 36*a* of the bottom base 34. The cutout 39 of the base plate 35 is located over the removal hole 37 of the bottom base 34. The cutout 39 and the removal hole 37 thus communicate with each other.

As illustrated in FIG. 10, the top member 17 is made of plastic and includes the rectangular frame portion 41. The frame portion 41 includes the upper frame section 41*a*, the lower frame section 41*b*, the left frame section 41*c*, and the right frame section 41*d*. The upper frame section 41*a* and the lower frame section 41*b* each extend along the length of the top member 17 and are spaced apart along the width of the top member 17. The left frame section 41*c* and the right frame section 41*d* each extend along the width of the top member 17 to couple the upper frame section 41*a* and the lower frame section 41*b* together at the opposite ends of the upper and lower frame sections 41*a*, 41*b*. The blade exposing hole 42 is formed in the region surrounded by the frame sections 41*a* to 41*d*. Four locking recesses 50, with which the distal ends of the locking projections 49 of the bottom base 34 are engageable, are formed in the frame portion 41. Two of the locking recesses 50 are formed in the inner surfaces of the upper frame section 41*a* at the opposite ends in the longitudinal direction. The other two of the locking recesses 50 are formed in the inner surfaces of the lower frame section 41*b* at the opposite ends in the longitudinal direction. A pair of positioning projections 52*b*, which is spaced apart along the length of the upper frame section 41*a*, is formed on the bottom surface of the upper frame section 41*a*. The aforementioned coupling projection 45 is attached to the lower end of the lower frame section 41*b*.

With reference to FIGS. 13A to 13D, an annular smoother functioning portion 48 is arranged on the skin contact surface of the top member 17. Surface modification treatment is performed on the plastic that constitutes the smoother functioning portion 48 to provide a hydrophilic property to the smoother functioning portion 48. The surface of the smoother functioning portion 48 thus holds water to generate a thin water film on the skin contact surface of the blade cartridge 11. This facilitates slide of the blade cartridge 11 when the razor is used, thus improving shaving comfort. After the use of the razor, the surface of the smoother functioning portion 48 dries to remove the water that has been held by the surface. The state before the use, in which the surface of the smoother functioning portion 48 does not hold the water, is thus restored. This restrains melting of the smoother functioning portion 48 when the razor is in use, thus ensuring the function of the smoother functioning portion 48 even after repeated use of the razor.

As illustrated in FIGS. 10 and 14A, an auxiliary blade 51 is arranged between the blade base member 16 and the top member 17. The auxiliary blade 51 is an independent component of the blade assembly 12. With reference to FIG. 11D, the auxiliary blade 51 is formed using a metal plate to define a substantially L-shaped cross section and is configured by a support plate portion 52 and a blade plate portion 53. Referring to FIG. 11D, the support plate portion 52 and the blade plate portion 53 are bent substantially at a right angle through a bent portion 55. The blade plate portion 53 includes a cutting edge 53*a*, which is formed in the peripheral portion of the auxiliary blade 51 extending along the length. As shown in FIG. 14A, the support plate portion 52 is clamped between the blade base member 16 and the top member 17. The cutting edge 53*a* of the blade plate portion 53 is exposed to the exterior of the blade assembly 12. The cutting edge 53*a* of the blade plate portion 53, which is an auxiliary cutting edge, faces substantially in the opposite direction to the facing direction of the cutting edge 13*a* of each main blade 13. The cutting edge 53*a* of the blade plate portion 53, which is the auxiliary cutting edge, is arranged on a side surface of the blade assembly 12. The cutting edges 13*a* of the main blades 13 are arranged on the upper surface of the blade assembly 12. With reference to FIG. 11D, a pair of positioning holes 52*a*, which extends through the support plate portion 52 along the thickness, is formed in the support plate portion 52. The two positioning holes 52*a* are spaced apart along the length of the auxiliary blade 51.

A method of assembling the blade cartridge 11 according to the fourth embodiment will hereafter be described.

As shown in FIGS. 12C and 12D, the base plate 35 is mounted on the distal ends of the bar spring portions 47 of the bottom base 34. The blade member 15 is then arranged in an upper section of the bottom base 34. Referring to FIG. 14A, the base plate 35 supports a portion of the blade member 15 so that the base plate 35 is mounted between the pairs of the leg portions 46 facing in the width direction of the seat 22. When the bar spring portions 47 are not in elastic deformation, the leg portions 46 of the seat 22 of the blade member 15 are spaced from the bottom base 34. Subsequently, as illustrated in FIG. 10, the frame portion 36 of the bottom base 34 and the frame portion 41 of the top member 17 are placed over each other with the auxiliary blade 51 clamped between the frame portions 36 and 41. At this stage, the distal ends of the locking projections 49 of the bottom base 34 are engaged with the corresponding locking recesses 50 of the top member 17 and the positioning projections 52*b* of the top member 17 are engaged with the corresponding positioning holes 52*a* of the auxiliary blade 51. The auxiliary blade 51 is thus fixed between the bottom base 34 and the top member 17. In this manner, the blade base member 16 and the top member 17 are joined to each other. The locking projections 49 and the locking recesses 50 each correspond to a positioning portion. Assembly of the blade cartridge 11 is thus completed in the above-described manner.

In the assembled blade cartridge 11, the leg portions 46 of the seat 22 are inserted into the gaps between the upper and lower frame sections 36*a*, 36*b* of the bottom base 34 and the corresponding upper and lower frame sections 41*a*, 41*b* of the top member 17 and thus become hidden from the exterior. The opposite ends of each blade 13 in the longitudinal direction of the blade member 15 are inserted between the left and right frame sections 36*c*, 36*d* of the bottom base 34 of the blade base member 16 and the corresponding left and right frame sections 41*c*, 41*d* of the top member 17. The seat 22 is urged toward the inner surfaces of the left and right frame sections 41*c*, 41*d* of the top member 17 by the elastic force of the bar spring portions 47 and is pushed down. The cutting edges 13*a* of the blades 13 are located in the vicinity of the skin contact surface extending continuously from the front surfaces of the upper and lower frame sections 41*a*, 41*b* of the top member 17. The blades 13 are movable, together with the blade supporting portion 24, each in an inward direction perpendicular to the skin contact surface against the elastic force of the bar spring portions 47. When the blades 13 are moved together with the blade supporting portion 24 by a predetermined amount, the leg portions 46 of the seat 22 come into contact with the bottom base 34. This restricts movement of the blades 13 beyond the predetermined amount.

Also in the fourth embodiment, by means of the reinforcement plate portions 33, which are formed in the blade attachment plate 27, the rigidity of the step plates 29 is set high. This maintains the relative positions of the blades 13. Shaving scum generated by the blades 13 enters the hollow 32 through the blade exposing hole 42 of the top member 17 and the through holes 31 of the blade attachment plate 27. The shaving scum is then discharged to the exterior through the removal hole 37 of the bottom base 34. Also, the razor of the fourth embodiment is enabled to shave by causing the bottom base 34 of the blade base member 16 to contact the skin surface together with the auxiliary blade 51.

Referring to FIG. 14A, the hollow 32 (which is a shaving scum removal hole) on the inner side of the seat 22 in the blade member 15 communicates with the exterior from the back surface of the blade assembly 12 through the cutout 39 of the base plate 35 and the shaving scum removal hole 37 of the bottom base 34. Also, the hollow 32 in the seat 22 communicates with the exterior from the front surface of the blade assembly 12 through the through holes 31 of the seat 22 and the blade exposing hole 42 of the top member 17.

A method of forming the auxiliary blade 51 will hereafter be described.

Figure 11A:
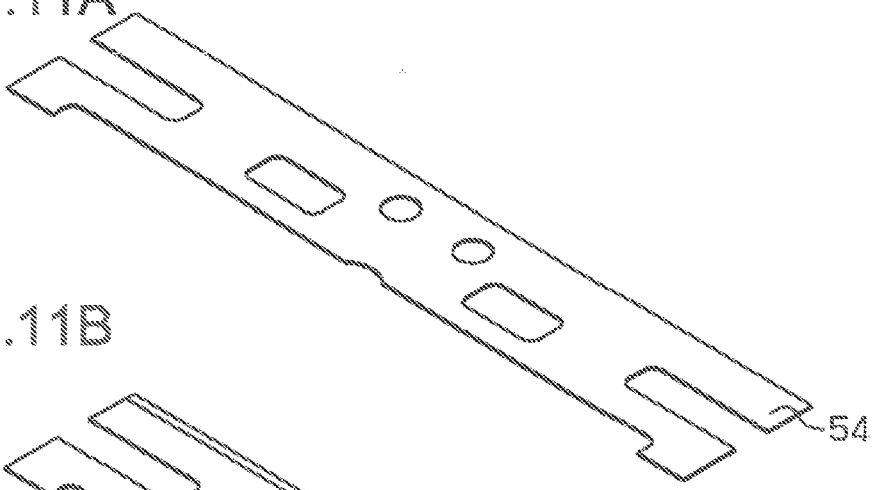
FIGS. 11A, 11B, 11C, and 11D are perspective views illustrating a process of manufacturing an auxiliary blade shown in FIG. 10.
Figure 11B:
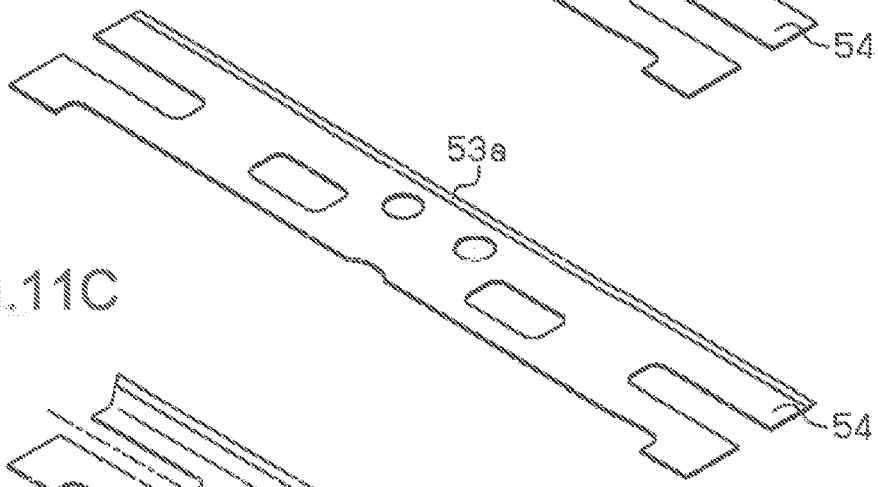
Figure 11C:
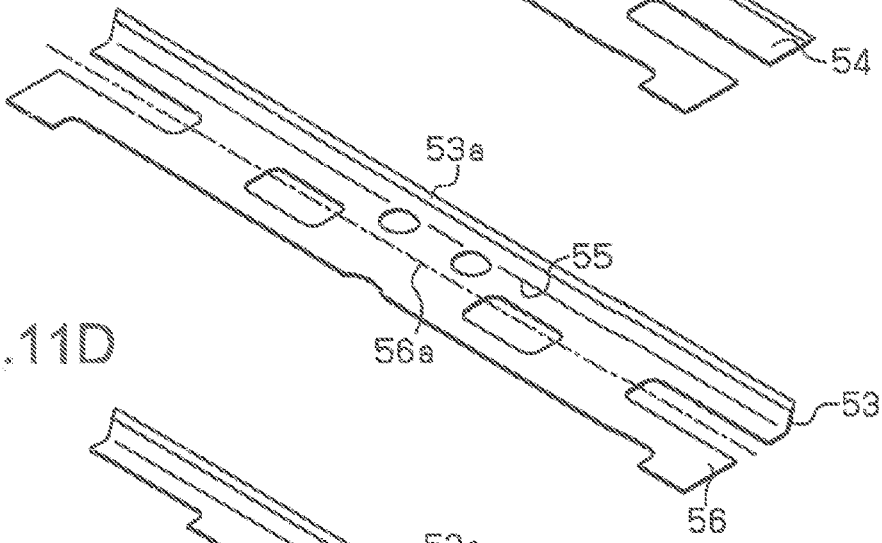
Figure 11D:
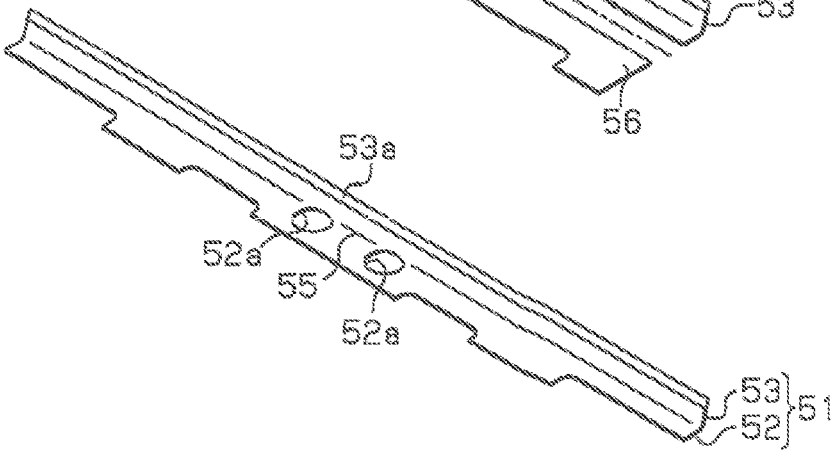

As illustrated in FIG. 11A, a substantially rectangular plate 54, which is, for example, an SUS420J2 material of stainless steel, is prepared. A plurality of holes is formed by pressing the material. With reference to FIG. 11B, the cutting edge 53*a* is formed on a first edge of the two edges of the plate 54 extending along the length. Subsequently, referring to FIG. 11C, the plate 54 is bent along a bending line extending along the length of the plate 54, which is set between a second side edge of the aforementioned two side edges, and the cutting edge 53*a*. Next, a cutting line 56*a* extending along the length of the plate 54 is set between the second side edge of the plate 54 and the bent portion 55. The plate 54 is then cut along the cutting line 56*a*. A cut plate section 56 is thus separated from the plate 54 and, as a result, the auxiliary blade 51 is completed. Bending illustrated in FIG. 11C or cutting illustrated in FIG. 11D may be carried out by a razor head assembling machine, for example, when the blade member 15 is arranged between the top member 17 and the blade base member 16.

The present embodiment has the following advantages.

(1) In the blade cartridge 11, the reinforcement plate portions 33 are arranged on the step plates 29. This maintains a high rigidity in the step plates 29 even when, for example, the thickness of the blade supporting portion 24 is set small to such an extent that bending of the blade supporting portion 24 or welding of the blades 13 to the step plates 29 are facilitated. As a result, even with the through holes 31 (which are shaving scum removal holes) formed in the blade supporting portion 24, deformation of the blade supporting portion 24 is restrained and shaving comfort of the razor is maintained.

The blades 13 are attached to the step plates 29 through spot welding or the like. The reinforcement plate portions 33 restrain promotion of deformation of the blade supporting portion 24 by the heat generated when the blades 13 are attached to the step plates 29.

(2) In the blade supporting portion 24 of the blade cartridge 11, the reinforcement plate portions 33 are bent from the blade supporting portion 24 toward the blade base member 16. The reinforcement plate portions 33 are thus formed in the hollow 32 of the seat 22. In this manner, the reinforcement plate portions 33 are easily formed simply by bending the blade supporting portion 24. Also, the reinforcement plate portions 33 are arranged without interfering with the use of the razor.

(3) Each reinforcement plate portion 33 is bent from the corresponding step plate 29 toward the blade base member 16 at the boundary between the reinforcement plate portion 33 and the step plate 29 and along the length of the blade supporting portion 24. In this manner, the reinforcement plate portions 33 are easily formed when the shaving scum removal holes 31 are formed. The reinforcement plate portions 33 and the shaving scum removal holes 31 are both arranged one by one for each of the step plates 29. This improves rigidity of the blade supporting portion 24 as a whole and facilitates removal of shaving scum to the exterior.

(4) The razor head 11 having the blade 51 includes the blade member 15 in which the main blades 13 are arranged, the blade base member 16 located on the back side of the razor head 11, and the top member 17 located on the near side of the razor head 11. The blade member 15 is arranged between the blade base member 16 and the top member 17. The cutting edges 13*a* of the main blades 13 of the blade member 15 are exposed to the exterior through the top member 17. The auxiliary blade 51 is arranged between the blade base member 16 and the top member 17. The cutting edge 53*a* of the auxiliary blade 51 is exposed to the side opposite from the side that the cutting edges 13*a* of the main blades 13 face. The support plate portion 52, which is clamped between the blade base member 16 and the top member 17, and the blade plate portion 53 having the cutting edge 53*a* are arranged in the auxiliary blade 51. The blade plate portion 53 is bent from the support plate portion 52 toward the side corresponding to the blade base member 16.

A razor head of a razor disclosed in Japanese National Phase Laid-Open Patent Publication No. 2007-528268 includes a blade member in which main blades are arranged, a blade base member located on the back side of the razor head, and a top member located on the near side of the razor head. The blade member is arranged between the blade base member and the top member. The cutting edges of the main blades of the blade member are exposed through the top member. The razor includes, in addition to the main blades, an auxiliary blade on the side opposite from the side that the cutting edges of the main blades face. The cutting edge of the auxiliary blade faces the side corresponding to the blade base member. The auxiliary blade of this conventional razor is easily applied to the part below the nose and earlock, which facilitates shaving of the mustache and grooming of the earlock. The razor is thus easy to use. However, the razor needs a great number of components to hold the flat blades, thus complicating the blade attachment structure.

In the configuration of the fourth embodiment, the auxiliary blade 51 is arranged at the side opposite from the side that the cutting edges 13*a* of the main blades 13 face. The auxiliary blade 51 is bent such that the cutting edge 53*a* faces the side corresponding to the blade base member 16. The auxiliary blade 51 is thus attachable to the razor head 11 with the support plate portion 52 or the bent portion 55, which is between the support plate portion 52 and the blade plate portion 53, maintained in a supported state. This ensures a simple blade attachment structure with a smaller number of components.

(5) The method of forming the auxiliary blade 51 for the razor having the blade plate portion 53 having the cutting edge 53*a* and the support plate portion 52 includes a step of forming the cutting edge 53*a* in the first side edge portion of the two side edges on the opposing sides of a plate, a step of bending the plate between the second side edge portion of the two sides on the opposing sides of the plate, and a step of cutting the cut step plate portion 56 away from the plate along the cutting line 56*a*, which is located between the bent portion 55 formed in the previous step and the second side edge portion of the plate and extends along the length of the plate. The method facilitates the forming of the auxiliary blade 51 using the plate.

Other than the illustrated embodiments, the configurations described below, for example, may be employed.

A plurality of separate blade members 15 may be prepared and arranged along the width of each blade member 15 between the blade base member 16 and the top member 17. In this case, the total number of the blades 13 of the razor corresponds to the number determined by multiplying the number of the blades 13 of each blade member 15 by the number of the blade members 15. For example, in a case of a first blade member 15 having three blades 13 combined with a second blade member 15 having three blades 13, a blade cartridge 11 having six blades 13 is configured. Alternatively, in a case of a first blade member 15 having three blades 13 combined with a second blade member 15 having two blades 13, a blade cartridge 11 having five blades 13 is configured. Also, in a case of a first blade member 15 having two blades 13 combined with a second blade member 15 having two blades 13, a blade cartridge 11 having four blades 13 is configured.

The direction in which the reinforcement plate portions 33 are bent is not restricted to the direction of the illustrated embodiments. Specifically, in each of the illustrated embodiments, each reinforcement plate portion 33 is bent along the bending line that is located at the boundary portion between the reinforcement plate portion 33 and the corresponding step plate 29 and extends along the length of the blade supporting portion 24, or in direction perpendicular to the elevation of FIG. 8A. The direction of the bending line may be changed. For example, each reinforcement plate portion 33 may be bent from the corresponding step plate 29 or the corresponding bridge portion 30 along a bending line that extends along the width of the blade supporting portion 24.

Each reinforcement plate portion 33 may be discontinuous in the extending direction of the reinforcement plate portion 33 and thus be divided into multiple sections. In this case, the extending length of each reinforcement plate portion 33 is set preferably to 50% or greater and, more preferably, to 75% or greater, with respect to the extending length of each step plate 29.

As long as the rigidity of each step plate 29 is improved, the form of each of the reinforcement plate portions 33, which are arranged on the step plates 29, may be modified. For example, a plurality of reinforcement plate portions may be placed over the back side of each step plate 29.

The reinforcement plate portions 33 may be configured separately from the seat 22. In this case, the reinforcement plate portions 33 are coupled to the seat 22 using coupling means such as welding, adhesive, or bolts and nuts.

The seat 22 may be formed by a method other than pressing, which is, for example, injection molding.

Each reinforcement plate portion 33 may be bent from the blade supporting portion 24 toward the blade base member 16 substantially by 180 degrees and placed over the blade supporting portion 24.

The bridge portions 30 may be configured separately from the blade supporting portion 24. In this configuration, the bridge portions 30 are coupled to the blade supporting portion 24 using the aforementioned coupling means.

DESCRIPTION OF THE REFERENCE NUMERALS

11 . . . Blade Cartridge (Razor Head), 13 . . . Blade, 13*a* . . . Cutting Edge, 15 . . . Blade Member, 16 . . . Blade Base Member, 17 . . . Top Member, 24 . . . Blade Supporting Portion, 29 . . . Step Plate (Blade Mounting Portion), 30 . . . Bridge Portion (Coupling Portion), 31 . . . Through Hole (Shaving Scum Removal Hole), 33 . . . Reinforcement Plate Portion (Reinforcement Portion).

The invention claimed is:

1. A razor comprising:

a blade member including blades and a blade supporting portion;

a blade base member arranged on a back side of the blade member; and a top member arranged on a near side of the blade member to hold the blade member between the top member and the blade base member with the blades of the blade member exposed to the exterior, wherein the blade supporting portion includes:

a plurality of blade mounting portions arranged in a direction in which the blades are arranged;

a reinforcement portion that improves rigidity of a corresponding one of the blade mounting portions; and a coupling portion that couples the blade mounting portions together;

wherein the blade member includes a seat in addition to the blades, the blades being mounted on the seat;

the seat is formed by pressing a plate and includes the blade supporting portion;

the blade supporting portion includes a blade attachment plate;

the blade attachment plate includes a plurality of step plates corresponding to the blade mounting portions, reinforcement plate portions corresponding to the reinforcement portions, and bridge portions for coupling the plurality of the step plates together;

the step plates are arranged in a stepped manner along the width of the seat;

each reinforcement plate portion is bent from the corresponding step plate toward the inner side of the blade member and along a length of the blade supporting portion;

the step plates, the reinforcement plate portions, and the bridge portions are formed integrally with one another;

the bridge portions extend in the arrangement direction of the step plates, a through hole for removing a shaving scum is formed between each adjacent pair of the step plates;

the through hole is divided by the bridge portion along the length of the through hole;

along the length of the seat, three sections of each through hole are arranged for the corresponding blade;

the through hole is formed when the reinforcement plate portions are bent from the plate for forming the seat; and the area of each through hole is equal to the area of the corresponding reinforcement plate portion.

2. The razor according to claim 1, wherein each of the reinforcement plate portions is bent toward the blade base member from one of two sides of the corresponding blade mounting portion in a blade arrangement direction, the one side being opposite from the cutting edge of the associated blade.

3. The razor according to claim 1 wherein the reinforcement plate portions extend in the extending direction of the cutting edge of each blade in correspondence with the through holes.

4. The razor according to claim 1, wherein the seat has a mounting base that is supported by the blade base member.

5. The razor according to claim 4, wherein an elastic portion is arranged between the mounting base of the seat and the blade base member to allow the blade member to move integrally in correspondence with pressing force applied to the blades of the blade member when the blades contact a skin surface.

6. The razor according to claim 4, wherein the mounting base of the seat has an elastic leg portion that is supported by the blade base member to allow the blade member to move integrally in correspondence with pressing force applied to the blades of the blade member when the blades contact a skin surface.

7. The razor according to claim 6, wherein the elastic leg portion comprises four leg plates, wherein the four leg plates are arranged in the vicinities of four corner sections of the seat, and wherein a distal end of each leg plate is held in contact with an upper surface of the blade base member.

* * * * *